US008042796B2

(12) United States Patent
Iguchi

(10) Patent No.: US 8,042,796 B2
(45) Date of Patent: Oct. 25, 2011

(54) SHEET FINISHING APPARATUS, SHEET PUNCHING APPARATUS AND CONTROL METHOD

(75) Inventor: Ken Iguchi, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 211 days.

(21) Appl. No.: 12/497,236

(22) Filed: Jul. 2, 2009

(65) Prior Publication Data

US 2010/0007084 A1 Jan. 14, 2010

Related U.S. Application Data

(60) Provisional application No. 61/079,084, filed on Jul. 8, 2008, provisional application No. 61/079,716, filed on Jul. 10, 2008, provisional application No. 61/079,718, filed on Jul. 10, 2008.

(51) Int. Cl.
*B65H 7/06* (2006.01)

(52) U.S. Cl. ..... 270/58.07; 270/58.02

(58) Field of Classification Search ..... 270/58.01, 270/58.02, 58.07

See application file for complete search history.

(56) References Cited

U.S. PATENT DOCUMENTS

| | | | | |
|---|---|---|---|---|
| 6,702,279 | B2 * | 3/2004 | Adachi et al. | 271/220 |
| 6,907,806 | B1 | 6/2005 | Okamoto et al. | |
| 7,546,081 | B2 * | 6/2009 | Tokita et al. | 399/407 |
| 7,650,823 | B2 * | 1/2010 | Iguchi | 83/13 |
| 2002/0008350 | A1 * | 1/2002 | Adachi et al. | 271/213 |
| 2005/0212194 | A1 * | 9/2005 | Moriyama et al. | 270/58.08 |
| 2006/0120783 | A1 | 6/2006 | Tokita et al. | |
| 2007/0062351 | A1 | 3/2007 | Iguchi | |
| 2008/0308989 | A1 | 12/2008 | Iguchi | |

FOREIGN PATENT DOCUMENTS

| | | | |
|---|---|---|---|
| JP | 2001-97638 | A | 4/2001 |
| JP | 2003-212424 | A | 7/2003 |
| JP | 2003-267621 | A | 9/2003 |
| JP | 2005-047642 | A | 2/2005 |
| JP | 2006-160518 | A | 6/2006 |

* cited by examiner

*Primary Examiner* — Leslie A Nicholson, III
(74) *Attorney, Agent, or Firm* — Patterson & Sheridan, LLP

(57) ABSTRACT

A sheet finishing apparatus includes a moving mechanism to move a puncher for boring punch holes in a sheet between a penetrate position and standby position, a detection section which is disposed upstream of the puncher in a sheet conveyance direction and detects a leading edge of the sheet, and a control section to control a moving mechanism based on a detection timing of the detection section and according to a size of the sheet and a movement speed of the sheet, so that a front corner of the sheet does not coincide with a position of a punching blade of the puncher when the sheet passes through the puncher.

18 Claims, 21 Drawing Sheets

TWO-HOLE TYPE (JAPAN/EUROPE)
FOUR-HOLE TYPE (FRANCE)
Φ6.5mm

TWO-HOLE, THREE-HOLE TYPE
(NORTH AMERICA)
Φ8.0mm

FOUR-HOLE TYPE
(SWEDEN)
Φ6.5mm

| TWO-HOLE, FOUR-HOLE | A4 | LT |
|---|---|---|
| 800mm/sec | 0 | a1 |
| 650mm/sec | a2 | a3 |
| 340mm/sec | a4 | a5 |

0<a1、a1<a2<a3、a3<a4<a5

| TWO-HOLE, THREE-HOLE | A4 | LT |
|---|---|---|
| 800mm/sec | b0 | b1 |
| 650mm/sec | b2 | b3 |
| 340mm/sec | b4 | b5 |

b0<b1、b1<b2<b3、b3<b4<b5

SHEET FINISHING APPARATUS, SHEET PUNCHING APPARATUS AND CONTROL METHOD

CROSS-REFERENCE TO RELATED APPLICATION

This application is based upon and claims the priority of U.S. Provisional Application No. 61/079,084, filed on Jul. 8, 2008, and U.S. Provisional Application No. 61/079,718, filed on Jul. 10, 2008, No. 61/079,716, filed on Jul. 10, 2008, the entire contents of which are incorporated herein by reference.

TECHNICAL FIELD

The present invention relates to a sheet finishing apparatus to perform finishing on a sheet ejected from an image forming apparatus, such as a copier, a printer or a multi-function peripheral (MFP), and a control method, and particularly to an improvement of a punch unit to bore a punch hole in a sheet.

BACKGROUND

In recent years, in an image forming apparatus (for example, MFP), a sheet finishing apparatus is disposed to be adjacent to the latter stage of the MFP in order to perform finishing on a sheet after image formation. The sheet finishing apparatus is called a finisher, and bores a punch hole in the sheet sent from the MFP or staples thereon.

In order to bore the punch hole in the sheet, the finisher is provided with a puncher having a plurality of punching blades. The punching blades are moved up and down by rotation of a punch motor, and the punching blades are moved down toward the paper face of the sheet, so that punch holes are bored in the sheet.

There is a case where the sheet sent from the MFP runs obliquely (hereinafter referred to as skew). When the punch hole is bored while the sheet is skewed, a trouble occurs when filing is performed. Thus, a skew correcting apparatus is provided to correct the skew of the sheet, and the punch hole is bored.

After the punch hole is bored in the sheet, the punching blade is stopped at rising position and the puncher stands by. When the punching blade is separated from the paper face, moves up and is located at the standby position, the position is the home position. Besides, a sensor to detect the lateral edge of the conveyed sheet is attached to the puncher, the puncher is moved in the direction perpendicular to the conveyance direction of the sheet, and the size of the conveyed sheet is detected by the sensor.

According to the sheet size or the hole type of the puncher, when a sheet is conveyed, the sheet may pass over the hole of the puncher, and there is a problem that when a curled sheet or a sheet with a folded front corner is carried in, the front corner of the sheet is caught by the hole of the puncher or the sensor, and a jam occurs.

JP-A-2003-212424 and JP-A-2006-160518 (US2006/0120783A1) disclose a sheet processing apparatus which prevents an end of a sheet from being caught in a hole of a punch unit.

JP-A-2003-267621 discloses a sheet processing apparatus which detects a lateral edge of a sheet and moves the position of a punching unit. JP-A-2001-97638 (U.S. Pat. No. 6,907,806B1) discloses a sheet processing apparatus including a sheet end detection sensor.

However, there is a case where when the sheet size, sheet conveyance speed, or hole type of the puncher varies, the front corner of the sheet is caught in the hole of the puncher, and a further improvement is requested.

Besides, there is a case where a puncher bores a punch hole in a sheet (tab sheet) having a tab. JP-A-2005-47642 discloses a sheet processing apparatus including a unit to determine whether a conveyed sheet is a tab sheet or not. In this example, the paper type is determined, and the stop timing at the penetrate position of the sheet is controlled.

However, there is a defect that since it is difficult to measure a skew amount when the tab sheet is skewed, a punch hole can not be bored at an accurate position.

SUMMARY

Described herein relates to a sheet finishing apparatus including:

a conveyance mechanism to convey a sheet supplied from an image forming apparatus in a conveyance direction;

a puncher having a plurality of punching blades to bore punch holes in the sheet conveyed by the conveyance mechanism;

a moving mechanism to locate the puncher at a penetrate position where the punch holes are bored in the sheet and a standby position where the puncher is retracted in a direction perpendicular to the conveyance direction;

a first detection section which is disposed upstream of the puncher in the conveyance direction and detects a leading edge of the sheet;

a second detection section which is disposed upstream of the puncher in the conveyance direction and detects a lateral edge of the sheet during a period when the puncher is moved from the standby position to the penetrate position; and a control section which controls the moving mechanism based on a detection timing of the first detection section and according to a size of the sheet and a movement speed of the sheet and prevents a front corner of the sheet from coinciding with positions of the punching blades.

DETAILED DESCRIPTION

Figure 1:
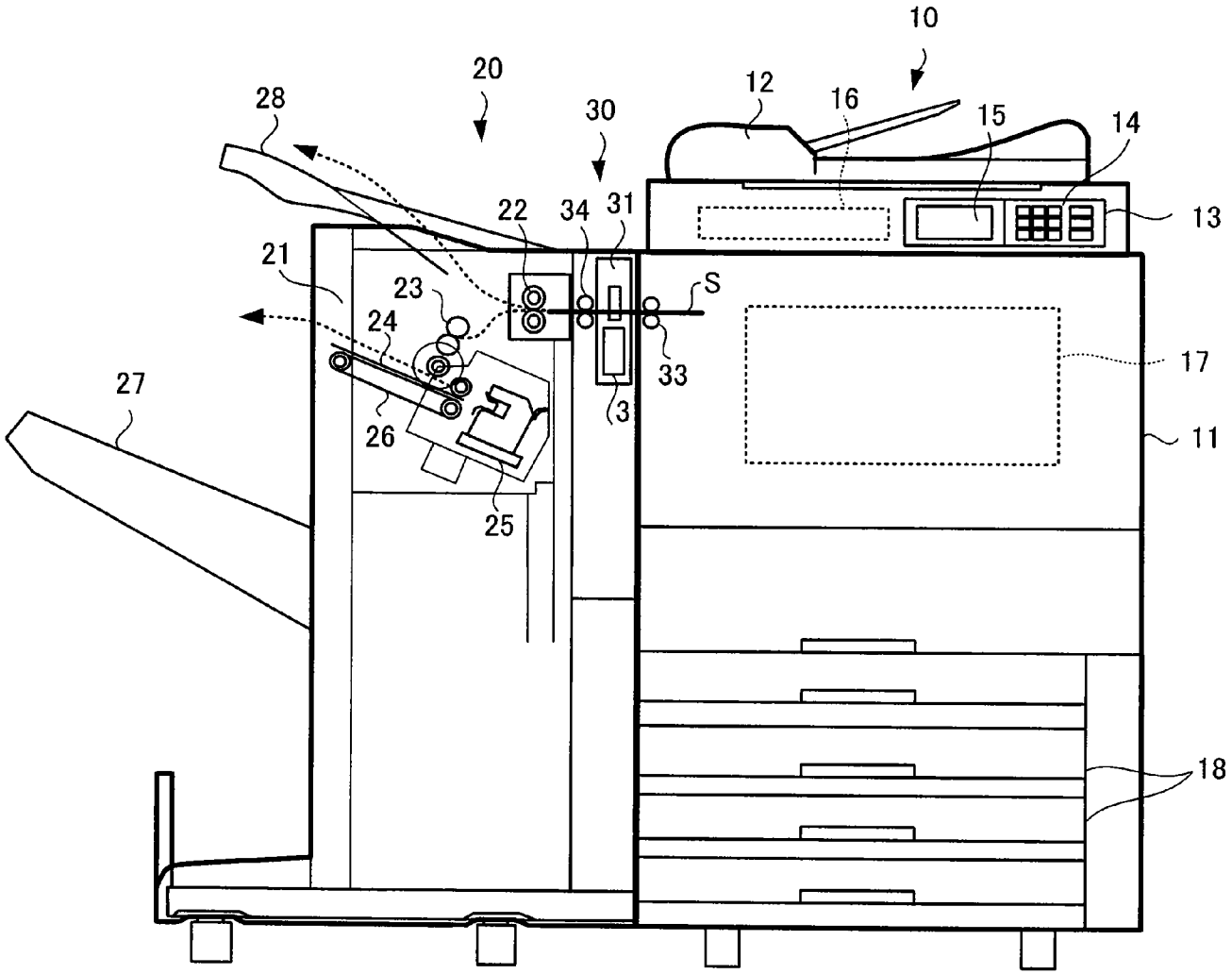
FIG. 1 is a whole structural view showing an embodiment of a sheet finishing apparatus.

Throughout this description, the embodiments and examples shown should be considered as exemplars, rather than limitations on the apparatus of the present invention.

Hereinafter, a first embodiment of a sheet finishing apparatus will be described in detail with reference to the drawings. In the respective drawings, the same portion is denoted by the same reference numeral.

FIG. 1 is a structural view showing an image forming apparatus including a sheet finishing apparatus.

In FIG. 1, reference numeral 10 denotes an image forming apparatus, which is, for example, an MFP (Multi-Function Peripherals) as a compound machine, a printer, a copier or the like. A sheet finishing apparatus 20 is disposed to be adjacent to the image forming apparatus 10. A sheet on which an image is formed by the image forming apparatus 10 is conveyed to the sheet finishing apparatus 20.

The sheet finishing apparatus 20 performs finishing on the sheet supplied from the image forming apparatus 10, and performs, for example, punching, sorting, stapling or the like. Hereinafter, the sheet finishing apparatus 20 will be called the finisher 20.

In FIG. 1, a document table is provided at an upper part of a main body 11 of the image forming apparatus 10, and an auto document feeder (ADF) 12 is openably and closably provided on the document table. An operation panel 13 is provided at an upper part of the main body 11. The operation panel 13 includes an operation section 14 having various keys and a touch panel type display section 15.

A scanner section 16 and a printer section 17 are included in the inside of the main body 11, and plural cassettes 18 containing sheets of various sizes are provided at a lower part of the main body 11. The scanner section 16 reads a document sent by the ADF 12 or a document placed on the document table.

The printer section 17 includes a photoconductive drum, a laser and the like, and the surface of the photoconductive drum is scanned and exposed by a laser beam from the laser, so that an electrostatic latent image is formed on the photoconductive drum. A charging unit, a developing unit, a transferring unit and the like are disposed around the photoconductive drum, the electrostatic latent image on the photoconductive drum is developed by the developing unit, and a toner image is formed on the photoconductive drum. The toner image is transferred to a sheet by the transferring unit. The structure of the printer 17 is not limited to the foregoing example, and there are various systems.

The sheet on which the image is formed by the main body 11 is conveyed to the finisher 20. In the example of FIG. 1, the finisher 20 includes a staple unit 21 to staple a sheet bundle, and a punch unit 30 to bore a punch hole in the sheet. The sheet subjected to finishing by the finisher 20 is ejected onto a storage tray 27 or a fixed tray 28.

The staple unit 21 will be described in brief. A sheet S supplied from the punch unit 30 is received by an inlet roller 22 of the staple unit 21 through a conveyance roller 34. A paper feed roller 23 is disposed downstream of the inlet roller 22, and the sheet S received by the inlet roller 22 is stacked on a processing tray 24 through the paper feed roller 23.

The sheet stacked on the processing tray 24 is guided to a stapler 25 and is stapled. Besides, a conveyance belt 26 to convey the sorted or stapled sheet S to the storage tray 27 is provided. The sheet S conveyed by the conveyance belt 26 is ejected onto the storage tray 27, and the storage tray 27 moves up and down and receives the sheet S.

There is also a case where the sheet S is not stapled but is ejected onto the storage tray 27. When the sheet S is not stapled, the sheet S is ejected without being dropped to the processing tray 24.

The staple unit 21 includes an alignment device to align the conveyed sheet in a width direction, and the sheet can also be sorted and ejected by using the alignment device. When finishing is not performed, the sheet conveyed from the main body 11 is directly ejected onto the storage tray 27 or the fixed tray 28.

On the other hand, the punch unit 30 is disposed between the main body 11 and the staple unit 21, and includes a punch box 31 and a dust box 32.

The punch box 31 includes punching blades to punch a sheet, and the punching blades moves down to bore a punch hole in the sheet. Punch dust generated by the punching falls into the dust box 32.

Plural rollers 33 and 34 for sheet conveyance are disposed on a passage extending from the main body 11 to the staple unit 21. The main body 11 supports the roller 33, and the roller 34 is located at the final outlet of the punch unit 30. The sheet ejected from the main body 11 is conveyed to the punch unit 30 by the roller 33, and is conveyed to the staple unit 21 by the roller 34. The rollers 33 and 34 constitute a conveyance mechanism to convey the sheet supplied from the image forming apparatus 10 in the conveyance direction. The punching by the punch unit 30 is performed when the user operates the operation panel 13 and a punch mode is set.

Figure 2:
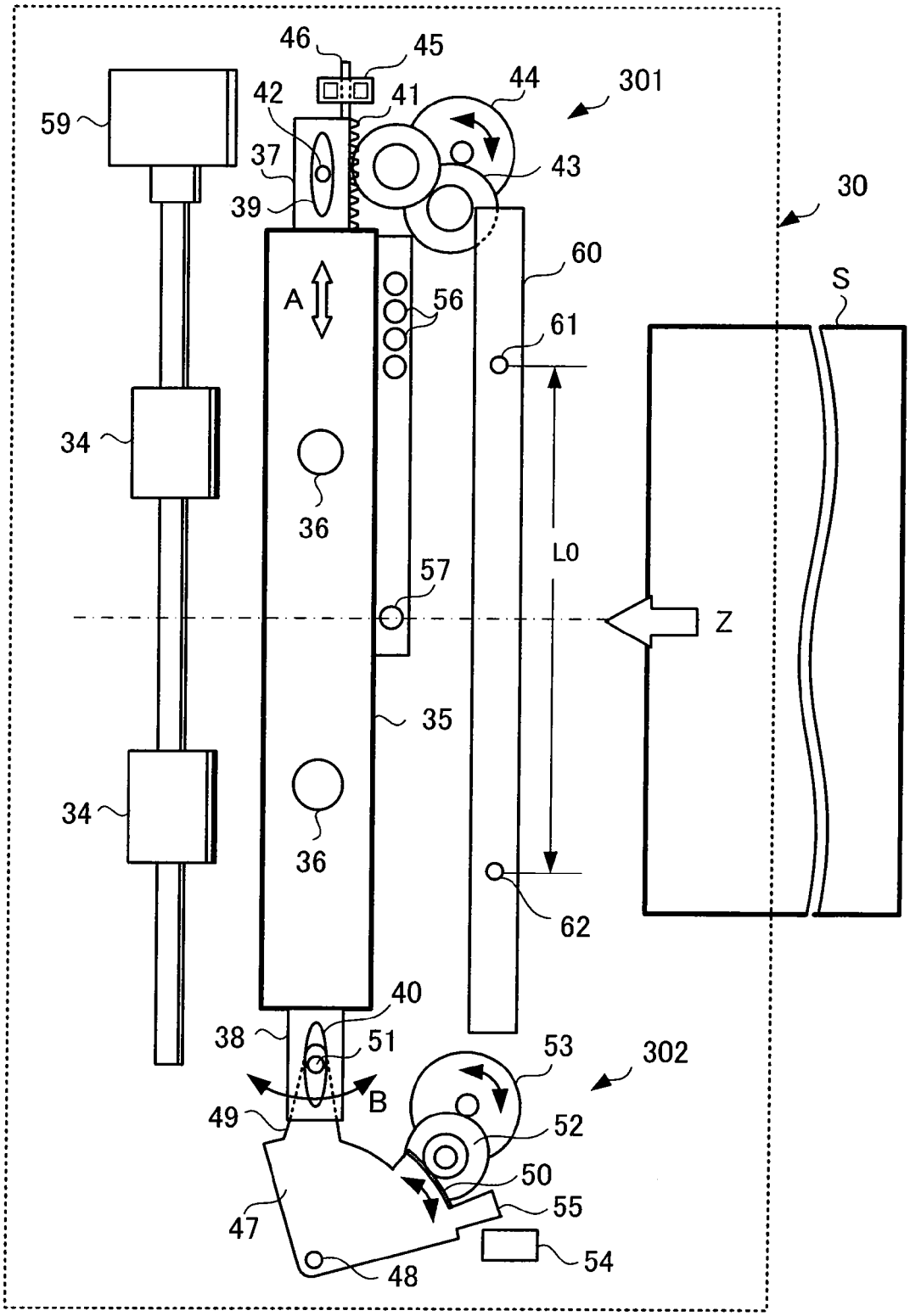
FIG. 2 is a plan view of a punch unit.

FIG. 2 shows a specific structure of the punch unit 30.

The punch unit 30 has a function to bore a punch hole in the sheet S and a function to correct a skew of the sheet S. The punch unit 30 includes a puncher 35 to bore a punch hole in the sheet S carried in from the main body 11 and a skew detection section 60 to detect the skew. The puncher 35 is provided downstream of the skew detection section 60.

The skew detection section 60 and the puncher 35 are perpendicular to a conveyance direction Z of the sheet S. The puncher 35 has plural (two in FIG. 2) punching blades 36.

Figure 3:
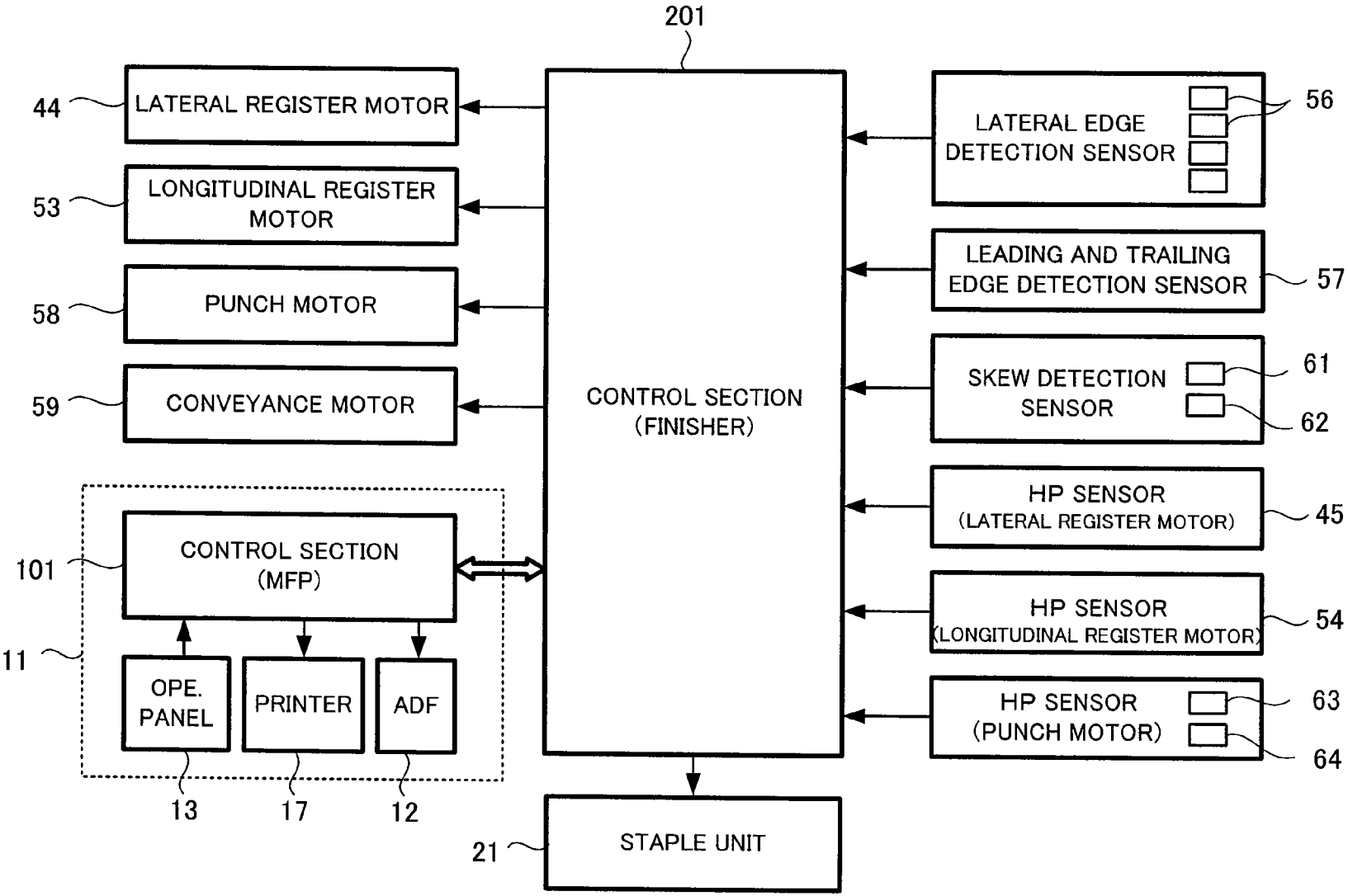
FIG. 3 is a block diagram of a control system of the sheet finishing apparatus.

The punching blades 36 move up and down by rotation of a punch motor 58 (FIG. 3). The punching blades 36 move down toward a paper face of the sheet S, so that punch holes are bored in the sheet S. Since a moving up and down mechanism for the punching blades 36 is generally well-known, its illustration will be omitted.

The puncher 35 can move in an arrow A direction (lateral direction) perpendicular to the conveyance direction Z of the sheet S, and one end (lower end of the drawing) of the puncher 35 turns in an arrow B direction (longitudinal direction) along the conveyance direction of the sheet S.

Projection pieces 37 and 38 are provided at both ends of the puncher 35 in the axial direction, and long holes 39 40 are formed in the projection pieces 37 and 38. A rack 41 is formed on the side surface of the one projection piece 37. A fixed shaft 42 provided at the main body side of the finisher 20 is fitted in the long hole 39 of the projection piece 37. Accordingly, the puncher 35 can move in the arrow A direction within the range of the length of the long hole 39 while the fixed shaft 42 is made a guide.

A gear group 43 which is engaged with the rack 41 and is rotated moves the puncher 35 in the lateral direction (A direction). A lateral register motor 44 rotates the gear group 43.

A sensor 45 is located at a position separate from the projection piece 37. The sensor 45 detects that the puncher 35 is moved in the arrow A direction and reaches the home position. The projection piece 37 is provided with a shutter 46 extending in the direction of the sensor 45, and when the shutter 46 crosses the sensor 45, it is detected that the puncher 35 moves to the home position in the A direction.

On the other hand, a fan-shaped cam 47 to turn the puncher 35 in the arrow B direction is coupled to the projection piece 38 of the puncher 35. The cam 47 turns around, as a fulcrum, a shaft 48 provided at the main body side of the finisher 20, has a lever 49 at one end, and has a gear 50 at the other end. The lever 49 is provided with a shaft 51, and the shaft 51 is fitted in the long hole 40 of the projection piece 38.

In order to turn the puncher 35 in the longitudinal direction (B direction), a gear group 52 which is engaged with the gear 50 and is rotated is provided, and a longitudinal register motor 53 to rotate the gear group 52 is provided. The cam 47 is rotated by rotation of the longitudinal register motor 53, the lever 49 is turned by the rotation of the cam 47, and the puncher 35 is turned in the longitudinal direction (B direction) while the fixed shaft 42 is made the fulcrum.

There is a sensor 54 at a position separate from the cam 47. The sensor 54 detects that the puncher 35 turns in the arrow B direction and turns to the home position. The cam 47 is provided with a shutter 55 extending in the direction of the sensor 54. When the shutter 55 crosses the sensor 54, sensor 54 is detected that the puncher 35 turns to the home position.

As stated above, the puncher 35 is moved in the lateral direction (A direction) by the rotation of the lateral register motor 44, and can turn in the longitudinal direction (B direction) by the longitudinal register motor 53.

A moving mechanism 301 moves the puncher 35 in the lateral direction (arrow A direction), and puncher 35 locates at the penetrate position and the standby position. A posture control mechanism 302 turns the puncher 35 in the longitudinal direction (arrow B direction) and controls the posture. The moving mechanism 301 in the lateral direction and the posture control mechanism 302 in the longitudinal direction, which are described above, constitute a movable mechanism to vary the position and inclination angle of the puncher 35.

As the lateral register motor 44 and the longitudinal register motor 53 is appropriate to use a stepping motor whose number of revolutions can be controlled by the number of pulses or the frequency. The movement distance of the puncher 35 in the lateral direction can be controlled by the number of pulses when the lateral register motor 44 is driven. The turning control of the puncher 35, that is, the angle can be controlled by the number of pulses when the longitudinal register motor 53 is driven.

Besides, a sensor group 56 to detect the end (lateral edge) of the sheet S in the lateral direction and a sensor 57 to detect the end (leading edge and trailing edge) of the sheet in the longitudinal direction when the sheet S is conveyed are provided at the puncher 35 on the carry-in side of the sheet S.

In the sensor group 56 and the sensor 57, for example, a light emitting element and a light receiving element are disposed to be opposite to each other, and when the sheet S is conveyed, the sheet S passes through between the light emitting element and the light receiving element, and the lateral edge, the leading edge and the trailing edge of the sheet S are detected.

The skew detection section 60 includes sensors 61 and 62 for skew detection. Each of the sensors 61 and 62 includes, for example, a light emitting element and a light receiving element opposite to the light emitting element. The sensors 61 and 62 detect the skew of the sheet S passing through between the light emitting element and the light receiving element.

The sensors 61 and 62 are disposed at an upstream side in the punch unit 30. The sensors 61 and 62 detect passing of the leading edge and the trailing edge of the sheet S. The sensor 61 and the sensor 62 are spaced from each other by a distance L0, and are arranged side by side in a direction perpendicular to the sheet conveyance direction.

Detection signals from the sensors 61 and 62 are sent to an after-mentioned control section. The control section is provided with timer counters, and the timer counters respectively start counting when the sensors 61 and 62 detect the passing of the leading edge of the sheet S. When the sheet S is not inclined at all with respect to the conveyance direction, the sensors 61 and 62 simultaneously detect the passing of the leading edge of the sheet S. Thus, the respective timer counters also simultaneously start the counting and a time difference does not occur.

When the sheet S is inclined and is conveyed, since a time difference occurs between the passing of the sheet S detected by the first sensor 61 and that detected by the second sensor 62, it can be known that the sheet S is skewed.

A skew difference distance (a) can be obtained from a difference between the time when the sensor 61 detects the sheet S and the time when the sensor 62 detects the sheet S, and a movement speed V of the sheet S. When the distance between the first sensor 61 and the second sensor 62 is L0, and a skew angle is (θ), the following expression (1) is established.

$$a = L0 \cdot \tan\theta \quad (1)$$

When the skew angle θ is obtained from the expression (1), the longitudinal register motor 53 is rotated by the angle θ to incline the puncher 35, and the skew correction is performed according to the skew amount of the sheet.

A conveyance roller 34 is driven by a conveyance motor 59, and conveys the sheet S conveyed from the upstream side (inlet side to the punch unit 30) of the conveyance path to the downstream side (outlet side of the punch unit 30) at the movement speed V. The conveyance motor 59 is, for example, a stepping motor, and rotates at a constant number of revolutions.

Next, a control system of the finisher 20 will be described with reference to a block diagram of FIG. 3.

In FIG. 3, a control section 201 controls the finisher 20, and includes a CPU (Central Processing Unit) a RAM, a ROM and the like. The control section 201 is connected with the sensor group 56 for lateral edge detection, the sensor 57 to detect the leading edge and the trailing edge of the sheet S, the sensors 61 and 62 for skew detection, and the home position sensors 45, 54, 63 and 64. Detection results from the respective sensors are inputted to the control section 201.

Besides, the control section 201 is connected with the lateral register motor 44, the longitudinal register motor 53, the punch motor 58, and the conveyance motor 59, and the control section 201 controls the rotation of the respective motors in response to the detection results of the various sensors.

The home position sensor 45 detects the home position when the puncher 35 is moved in the lateral direction (A direction) by the lateral register motor 44. The home position in the lateral direction is the center part of the conveyance path of the sheet S and corresponds to the penetrate position.

The home position sensor 54 detects the home position when the puncher 35 is turned in the longitudinal direction (B direction) by the longitudinal register motor 53. The home position in the longitudinal direction is the position where the puncher 35 is most inclined.

The home position sensors 63 and 64 detect the home position when the punching blade 36 is moved up and down by the punch motor 58. The home position of the punching blade 36 is a state where the punching blade 36 is pulled out from the sheet S, that is, a standby position separate from the paper face of the sheet S.

The control section 201 is connected to a control section 101 to control the main body (MFP) 11. The control section 101 is connected with the respective sections of the main body 11, for example, the operation panel 13, the printer section 17, the ADF 12 and the like. Besides, the control section 201 controls the staple unit 21. The control section 201 and the control section 101 operate in cooperation with each other, and instruct stapling or punching by the operation of the operation panel 13. Besides, the designation of the sheet size, the instruction of the number of copies, the input of sheet type and the like are performed by the operation of the operation panel 13.

Next, a basic operation of the punch unit 30 will be described with reference to FIGS. 4A and 4B and FIGS. 5A and 5B. FIG. 4A shows an initial state of the punch unit 30. When receiving the instruction of punching from the main body 11, the control section 201 drives the longitudinal register motor 53 to control the posture control mechanism 302, turns the puncher 35 in an arrow B1 direction along the conveyance direction of the sheet S, and sets the puncher in an inclined state. The state in which the puncher is turned in the arrow B1 direction and is inclined is the home position in the longitudinal direction.

Besides, the control section 201 drives the lateral register motor 44 to control the moving mechanism 301, moves the puncher 35 by the gear group 43 in an arrow A1 direction crossing the conveyance direction of the sheet S, and sets the puncher at the retract position.

When the sheet S is carried in, the skew detection section 60 detects the skew amount of the leading edge of the sheet S. When the skew amount is detected, the control section 201 drives the longitudinal register motor 53, and inclines the puncher 35 in an arrow B2 direction according to the skew amount of the sheet S as shown in FIG. 4B.

Figure 4B:
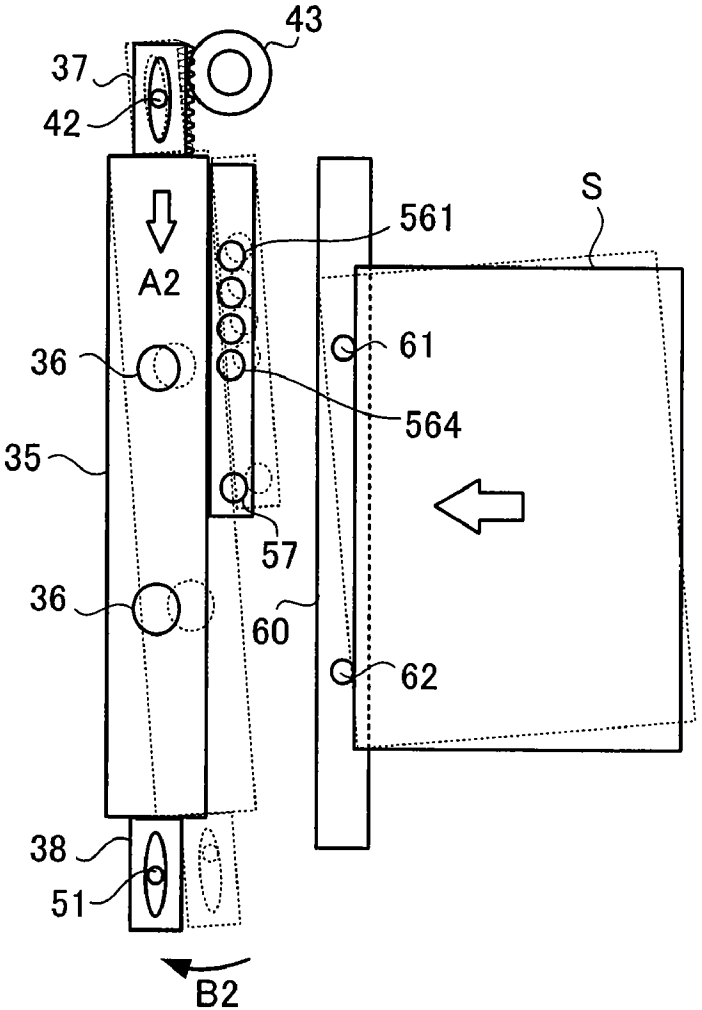
FIGS. 4A and 4B and FIGS. 5A and 5B are plan views showing a basic operation of the punch unit.
Figure 4A:
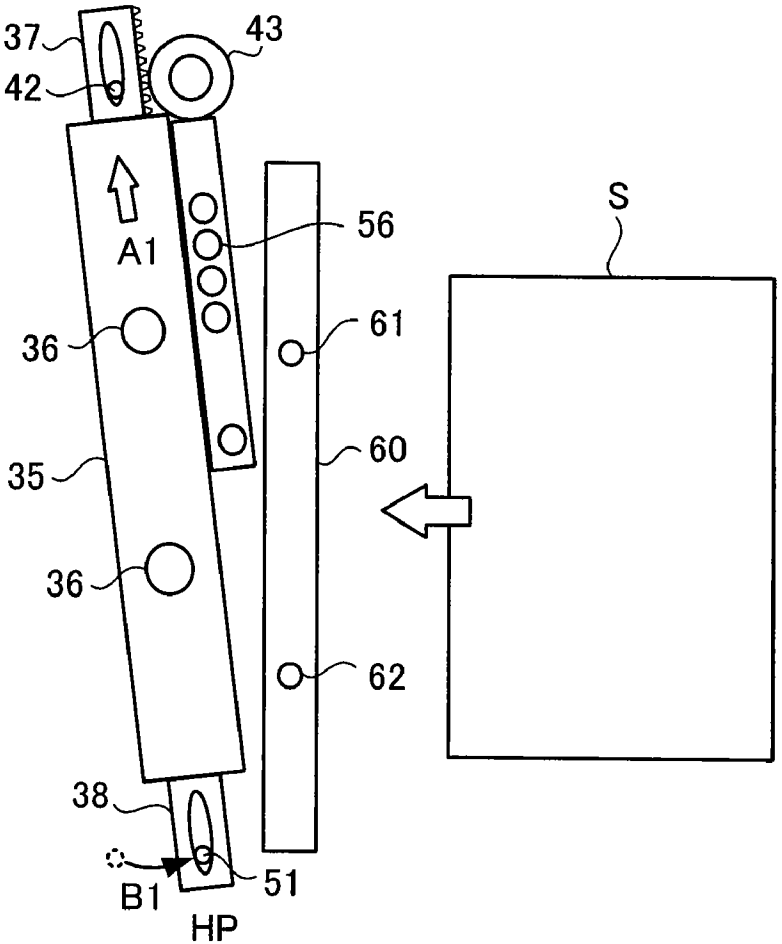

A thin dotted line of FIG. 4B shows a state where the puncher 35 is inclined according to the skewed sheet S. When the sheet S is not skewed, as indicated by a solid line, the puncher 35 is disposed to be perpendicular to the conveyance direction of the sheet S.

Next, the sensor 57 detects the leading edge of the sheet S, and when it is detected that the sheet S is conveyed by a specified amount, the lateral register motor 44 is driven to move the puncher 35 from the retract position to the center of the conveyance path in an arrow A2 direction. When the puncher is moved in the arrow A2 direction, the sensor group 56 detects the lateral edge of the sheet S along the conveyance direction.

The lateral edge detection is performed such that a sensor in the sensor group 56 is specified according to the sheet size instructed by the operation panel 13, and the detection is performed by the specified sensor. For example, the lateral edge of A4 size is detected by using an outside sensor 561. When the sheet size is small, the detection is performed by using an inside sensor 564. When the lateral edge is detected by a sensor in the sensor group 56, the lateral register motor 44 is stopped and the movement of the puncher 35 is also stopped.

Figure 5B:
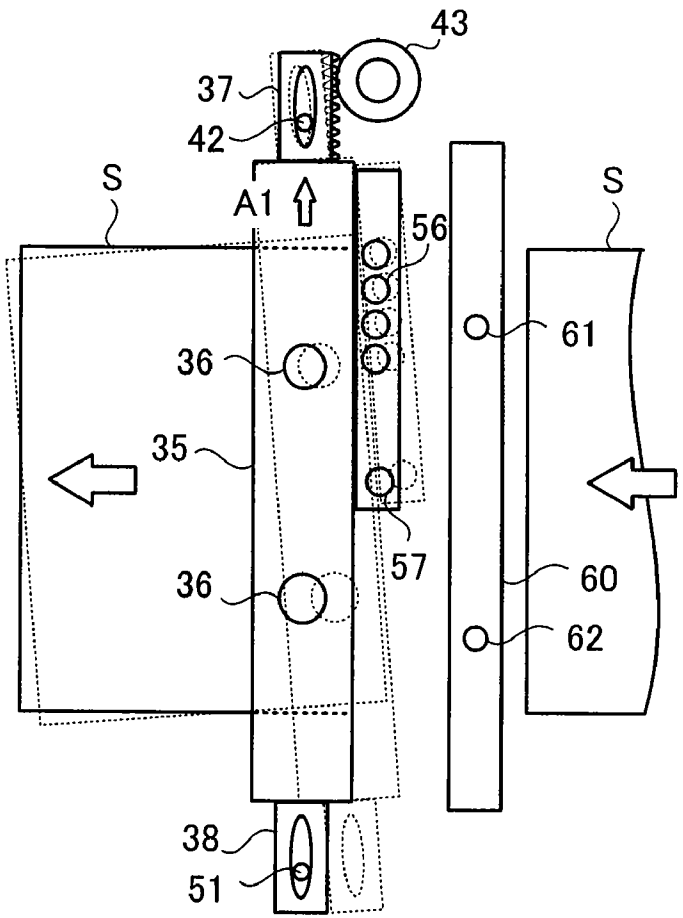
Figure 5A:
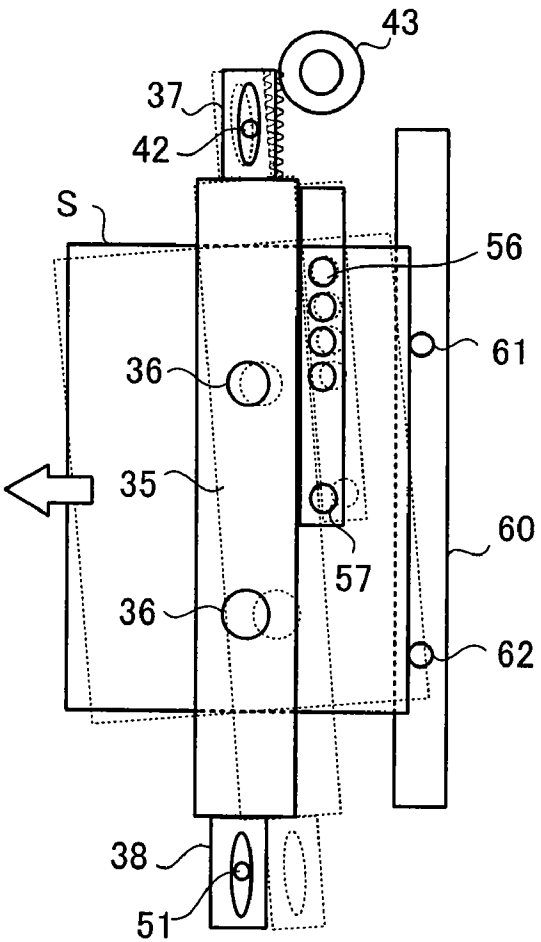

When the conveying of the sheet S proceeds, as shown in FIG. 5A, the skew detection section 60 detects the skew amount of the trailing edge of the sheet S. When there is a difference between the skew amount of the leading edge and the skew amount of the trailing edge, the longitudinal register motor 53 is driven and the inclination of the puncher 35 is finely adjusted by the amount of the difference. Besides, when there is a shift in the lateral edge of the sheet S, the lateral register motor 44 is driven and the position of the puncher 35 in the lateral direction is also finely adjusted.

Then, as shown in FIG. 5B, after the trailing edge of the sheet S is detected by the sensor 57, the sheet S is conveyed from the position where the trailing edge is detected to the specified position where punching is performed, and the conveyance motor 59 is stopped. The punch motor 58 is driven in the state where the conveyance motor 59 is stopped, and the punching blades 36 move down to bore punch holes in the sheet S.

With respect to the driving of the punch motor 58, consideration is given to a time elapsed before the punching blades 36 contact with the sheet, and the driving may be started at a timing earlier than the stop of the conveyance motor 59. When the driving is started at the early timing, the driving of the punch motor 58 is started after a previously set time passes since the trailing edge of the sheet S is detected by the sensor 57.

When the punching of the punch holes is ended, the control section 201 again drives the conveyance motor 59 to eject the punched sheet. When there is a next sheet, the operation of FIG. 4A to FIG. 5B is repeated, and when there is no subsequent sheet, the respective devices are set at the home positions (HP) and the operation is ended.

Figure 6:
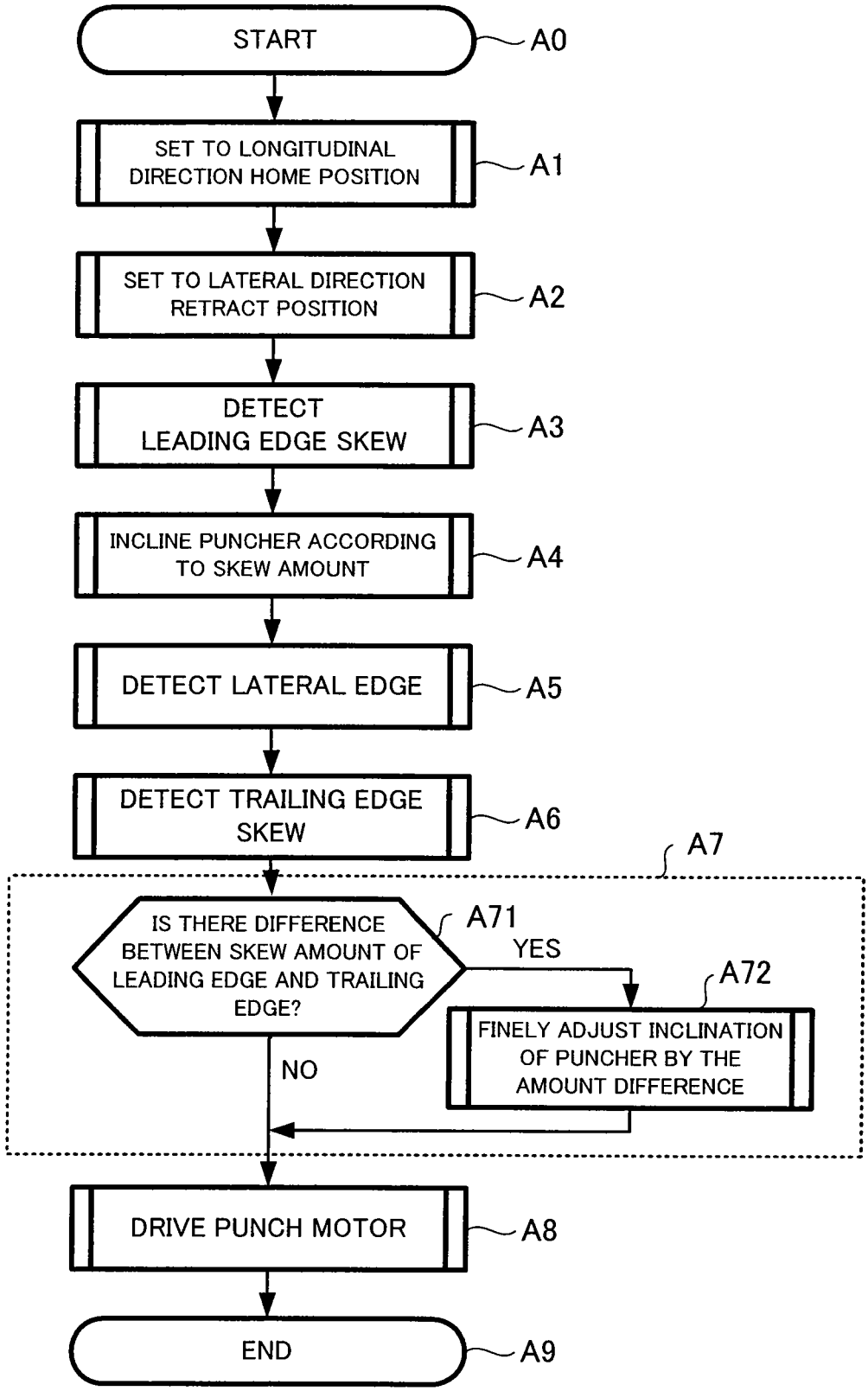
FIG. 6 is a flowchart showing an operation of the punch unit.

FIG. 6 is a flowchart for explaining the above operation.

In FIG. 6, Act A0 is a start of punching. At Act A1, the longitudinal register motor 53 is driven, and the puncher 35 is turned and is set at the home position in the longitudinal direction. At Act A2, the lateral register motor 44 is driven, and the puncher 35 is moved in the arrow A1 direction perpendicular to the conveyance direction of the sheet S and is set at the retract position.

At Act A3, the skew detection section 60 detects the skew of the leading edge of the conveyed sheet S. When the skew amount is detected by the skew detection section 60, at Act A4, the longitudinal register motor 53 is driven, and the puncher 35 is turned according to the skew amount of the conveyed sheet S and is inclined.

When the leading edge of the sheet S is detected by the sensor 57, the lateral register motor 44 is driven to move the puncher 35 from the retract position to the center of the conveyance path. At Act A5, the sensor group 56 detects the lateral edge of the sheet S. When the lateral edge is detected, the lateral register motor 44 is stopped, and the movement of the puncher 35 is also stopped. When the conveying of the sheet S proceeds, at Act A6, the skew detection section 60 detects the skew amount of the trailing edge of the sheet S.

At Act A71 of Act A7, it is determined whether there is a difference between the skew amount of the leading edge and the skew amount of the trailing edge, and when there is a difference, at Act A72, the longitudinal register motor 53 is driven, and the inclination of the puncher 35 is finely adjusted by the amount of the difference. When there is a shift in the lateral edge of the sheet S, the lateral register motor 44 is driven, and the puncher 35 is finely adjusted also in the lateral direction.

After the skew correction is performed, the sheet S is conveyed to the specified position where punching is performed, and the driving of the conveyance motor 59 is stopped. At Act A8, the punch motor 58 is driven to move down the punching blades 36, and punch holes are bored in the sheet S. When the punching process of the punch holes is ended, the conveyance motor 59 is again driven to eject the sheet subjected to the punching process. When there is a next sheet, the process of Act A1 to Act A8 is repeated, and when there is no subsequent sheet, the respective devices are set at the home positions (HP), and the punch process is ended at Act A9.

Figure 7:
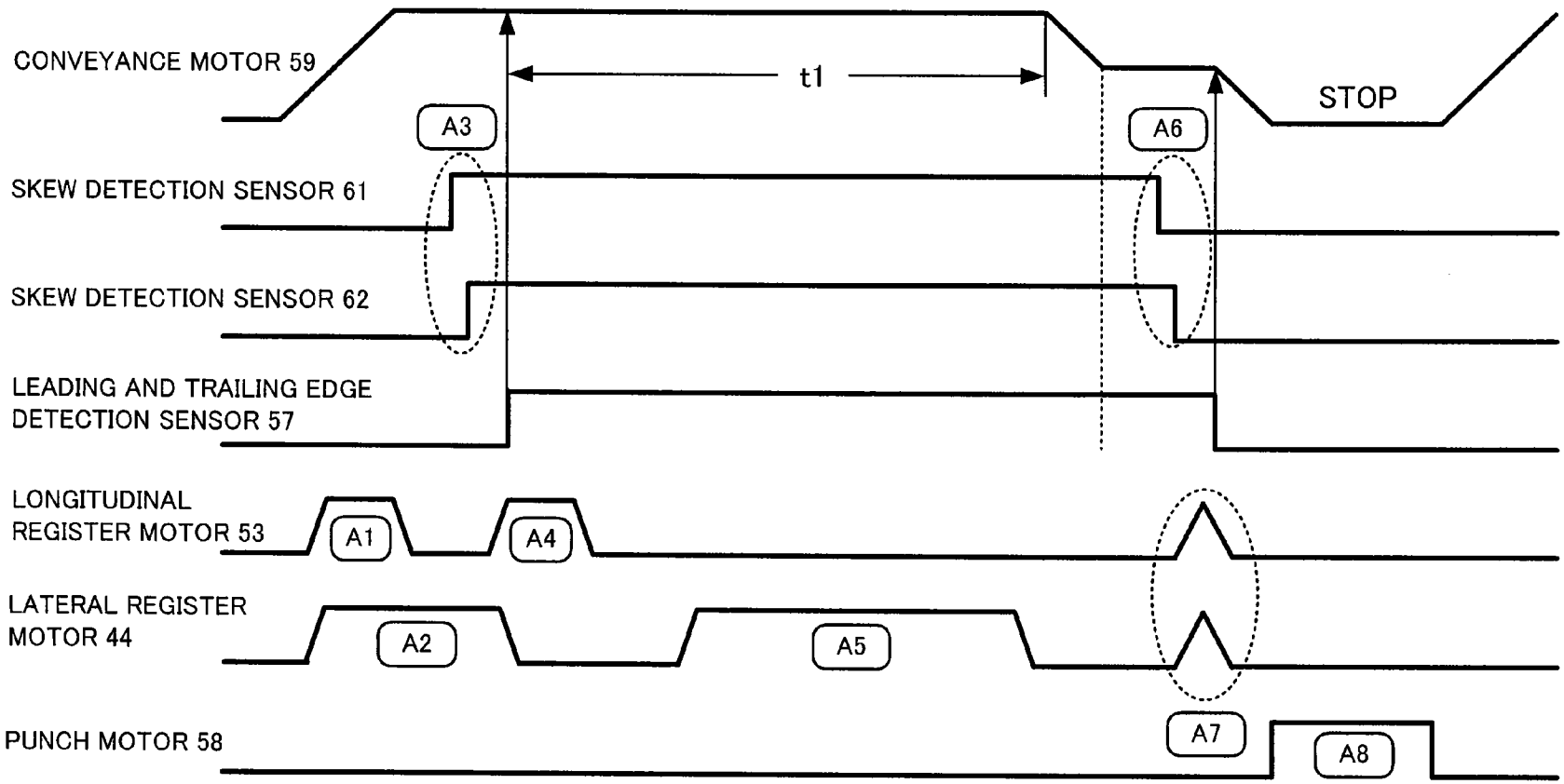
FIG. 7 is a timing chart showing the operation of the punch unit.

FIG. 7 is a timing chart for explaining the operation of the flowchart of FIG. 6. FIG. 7 shows operation timings of the conveyance motor 59, the sensors 61 and 62 for skew detection, the leading edge and trailing edge detection sensor 57, the longitudinal register motor 53, the lateral register motor 44, and the punch motor 58.

A1 to A8 shown in FIG. 7 correspond to Act A1 to Act A8 of the flowchart of FIG. 6, and various detections and processes are executed in order of A1 to A8.

As is understood from FIG. 7, the conveyance motor 59 is triggered when the trailing edge of the sheet S is detected by the sensor 57, and decreases the speed at the time point when a previously set time (t1) passes, and after the speed is decreased, the rotation is stopped. When the conveyance motor 59 is stopped, the punch motor 58 is driven and punching is performed.

Accordingly, when the time t1 is accurately set, the punching position of the sheet S is determined. For example, when the stepping motor is used as the conveyance motor 59, the number of revolutions of the conveyance motor 59 in a time t1, that is, the conveyance distance of the sheet S can be made constant by setting the number of pulses, and the punching position can be set.

Next, an operation of the punching blades 36 of the puncher 35 will be described with reference to FIG. 8 and FIG. 9.

Figure 8A:
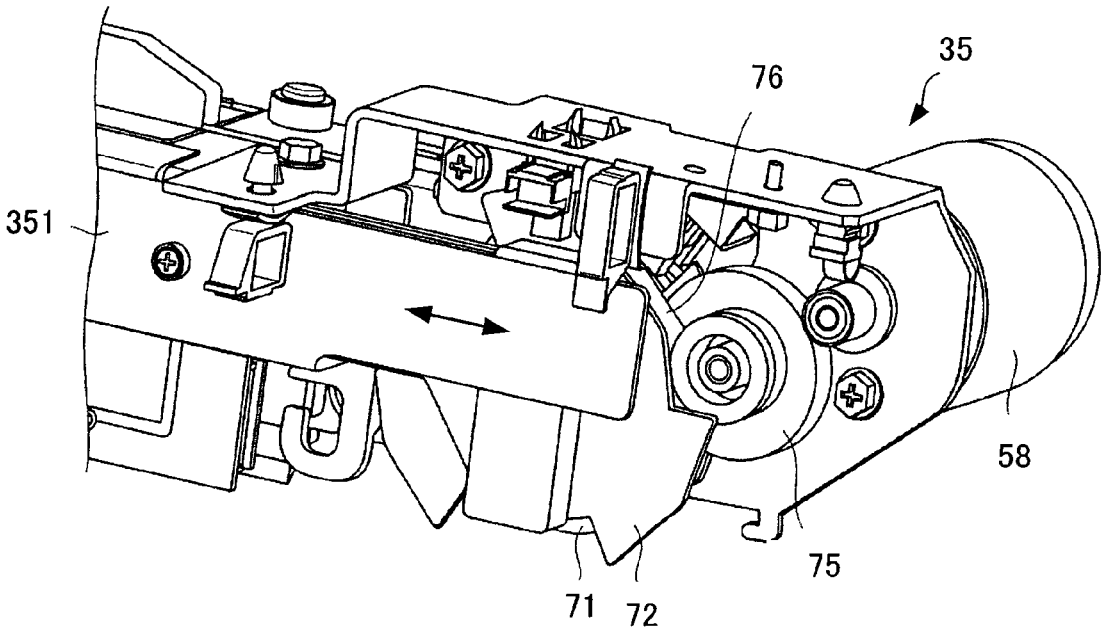
FIGS. 8A, 8B and 8C are a perspective view showing a structure of a main section of a puncher and operation explanatory views.

FIG. 8A is an enlarged perspective view showing a part of the puncher 35. The puncher 35 is provided with the plural punching blades 36 (see FIG. 2) for performing punching. The punching blades 36 are driven in an up-and-down direction according to the slide of a slide link 351, and the slide link 351 is driven by the punch motor 58. Since a structure to drive the punching blades 36 by using the slide link 351 is a generally well-known technique, the details will be omitted.

The puncher 35 includes a home position detection section 71 to detect the home position (standby position) of the punching blades 36, a trigger section 72 to generate triggers of drive and stop of the punch motor 58, a gear 75, a crank gear 76 and the like.

The gear 75 to transmit the rotation of the punch motor 58 to the slide link 351, the crank gear 76, and a member to drive the punching blades 36 by the slide of the slide link 351 constitute a drive mechanism. The drive mechanism drives the punching blades 36 between the penetrate position where the punch holes are bored in the sheet and the standby position separate from the sheet.

The outline of the operation of the puncher 35 will be described. When the conveyed sheet S enters the puncher 35, the punch motor 58 alternately repeats a half forward rotation and a half reverse rotation, and slides the slide link 351 right and left.

The punching blades 36 move up and down by the slide of the slide link 351, and bore the punch holes in the sheet S. That is, when the punch motor 11 is half rotated, the first punching is performed, and the punch motor 58 is half rotated in the reverse direction, punching is performed in the next sheet.

There is also a puncher in which when the punch motor 58 makes one rotation, punching is performed once. In the puncher in which punching is performed once when the punch motor 58 makes one rotation, the punch motor 58 rotates only in one direction, and repeats the punch operation. Besides, as the puncher 35, there is a puncher having two holes for punching or having four holes.

Figure 8B:
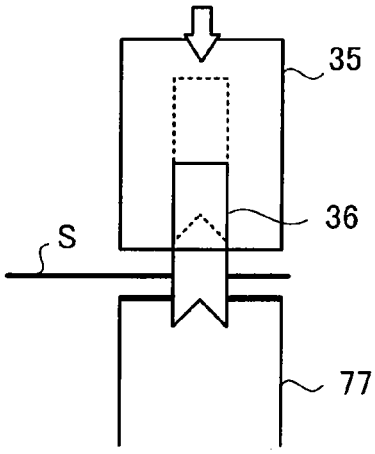
Figure 8C:
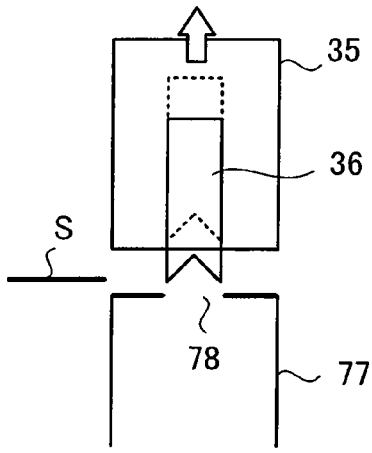

FIG. 8B shows a state in which the punching blades 36 are moved down and the punching blades 36 are driven into the sheet S. FIG. 8C shows a state where the punching blades 36 are moved up, and the punching blades 36 are separated from the sheet S. A die 77 is disposed opposite to the puncher 35, and as shown in FIG. 8C, the die 77 has punch holes 78 through which the punching blades 36 pass. The holes 78 are respectively formed at positions opposite to the punching blades 36.

Figure 9B:
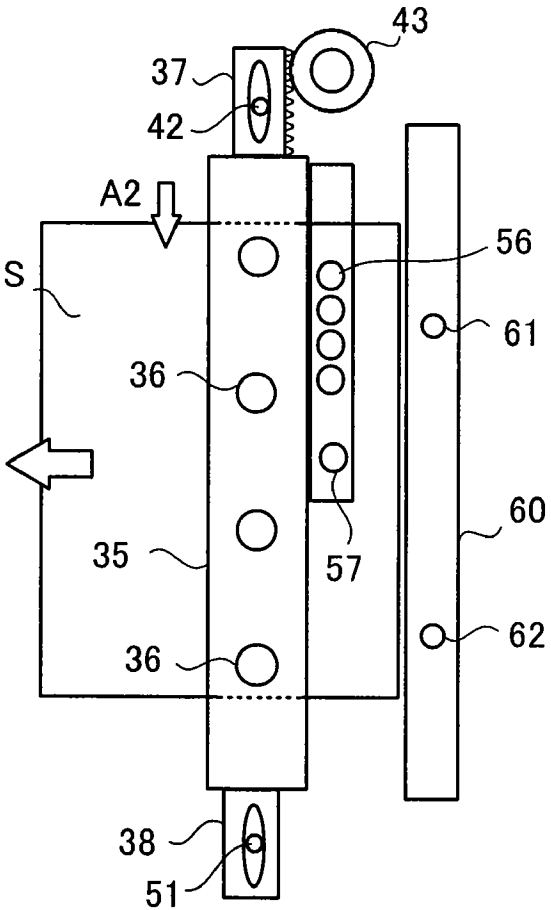
FIGS. 9A and 9B are operation explanatory views showing movement of the puncher.
Figure 9A:
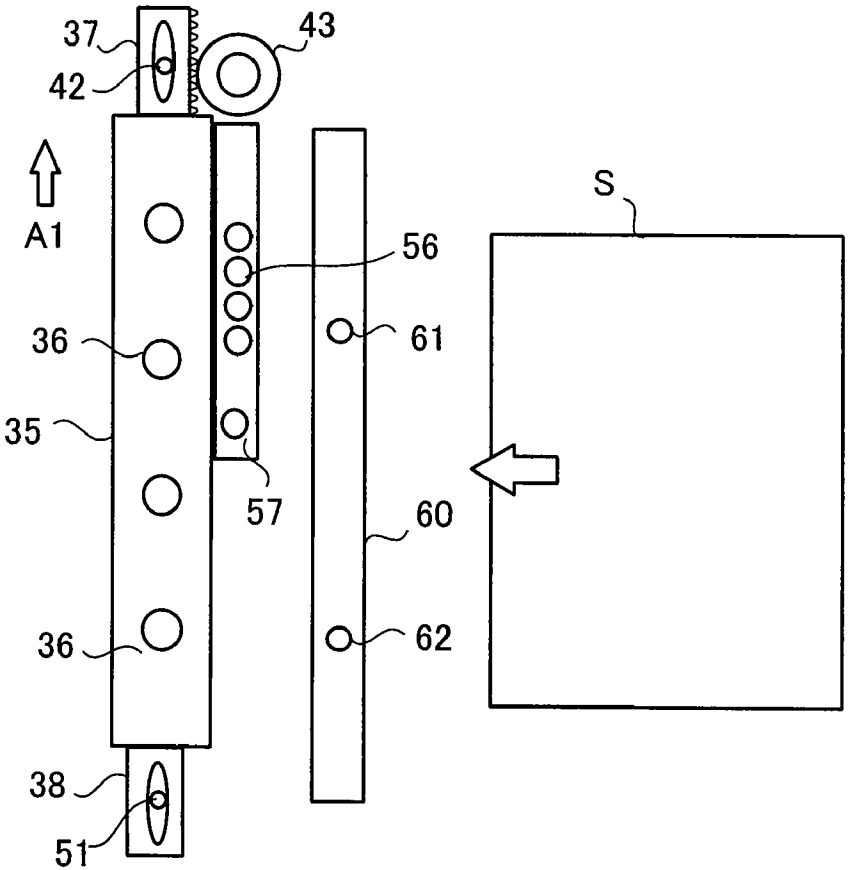

Next, the movement control of the puncher 35 in the lateral direction (direction of the arrows A1 and A2) will be specifically described with reference to FIG. 9A and FIG. 9B. FIGS. 9A and 9B show an example in which a four-hole puncher 35 having four punching blades 36 is used.

As shown in FIG. 9A, the puncher 35 is moved to a standby position (arrow A1 direction) by the lateral register motor 44 before the leading edge of a sheet S is carried into the puncher 35. When the leading edge of the sheet S is detected by a sensor 57 and is conveyed by a specified number of pulses, as shown in FIG. 9B, the puncher 35 moves in the arrow A2 direction, and a sensor group 56 detects the lateral edge of the sheet.

Figure 10:
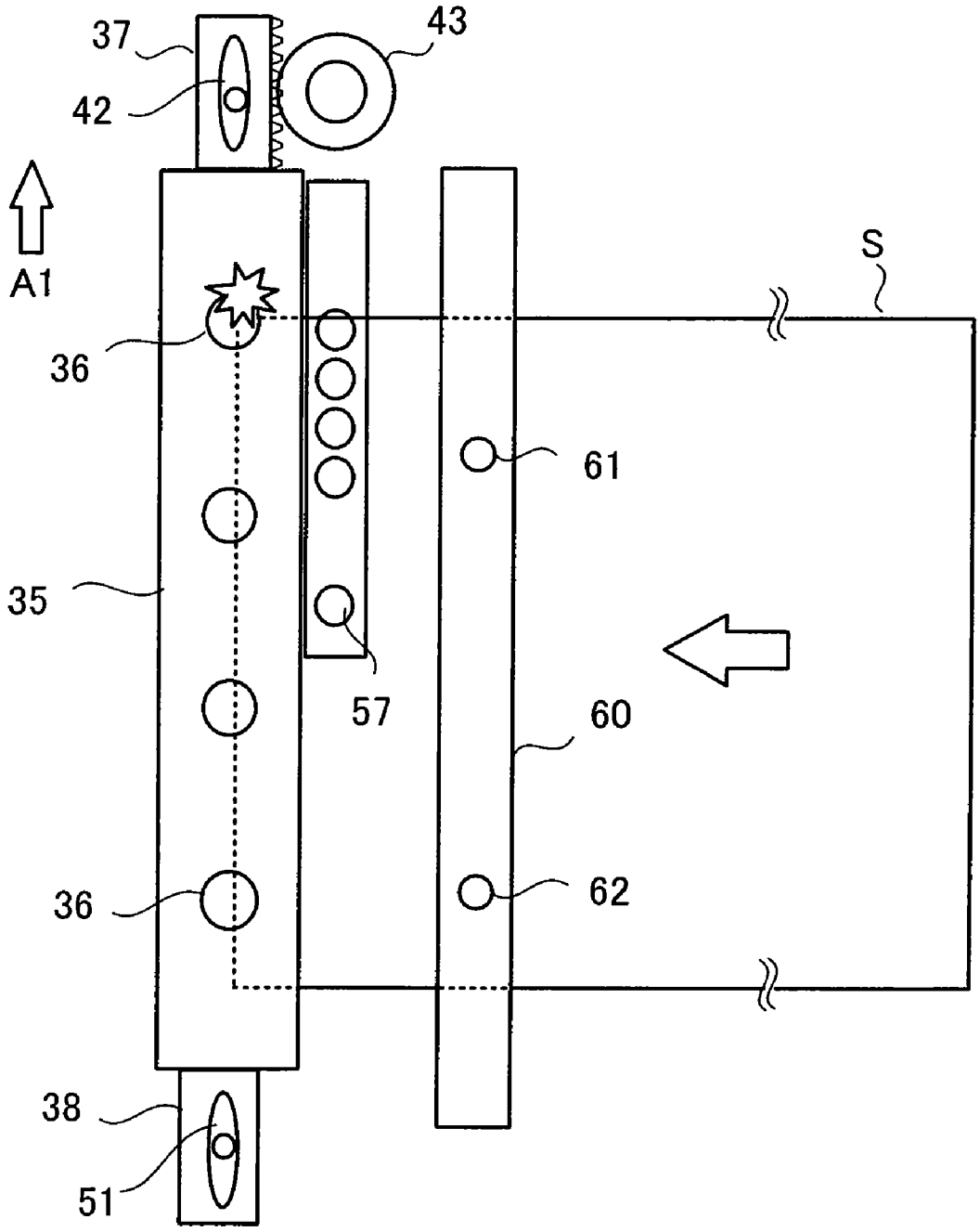
FIG. 10 is an operation explanatory view showing occurrence of a jam of a sheet.

However, as shown in FIG. 10, when the puncher 35 is at the standby position, a front corner of the sheet coincides with the position of a punching blade 36 according to the size of the sheet S, and the front corner of the sheet S enters the punch hole 78 (FIG. 8C) and a jam occurs. For example, when the sheet S is curled, the front corner of the sheet S enters the punch hole 78. FIG. 10 shows a state where the front corner of the sheet S enters the hole 78 opposite to the punching blade 36 located at the uppermost position in the drawing.

In order to prevent the front corner of the sheet S from entering the hole 78, when the leading edge of the sheet S passes through the puncher 35, the front corner of the sheet S is made not coincide with the position of the punching blade 36.

Figure 11B:
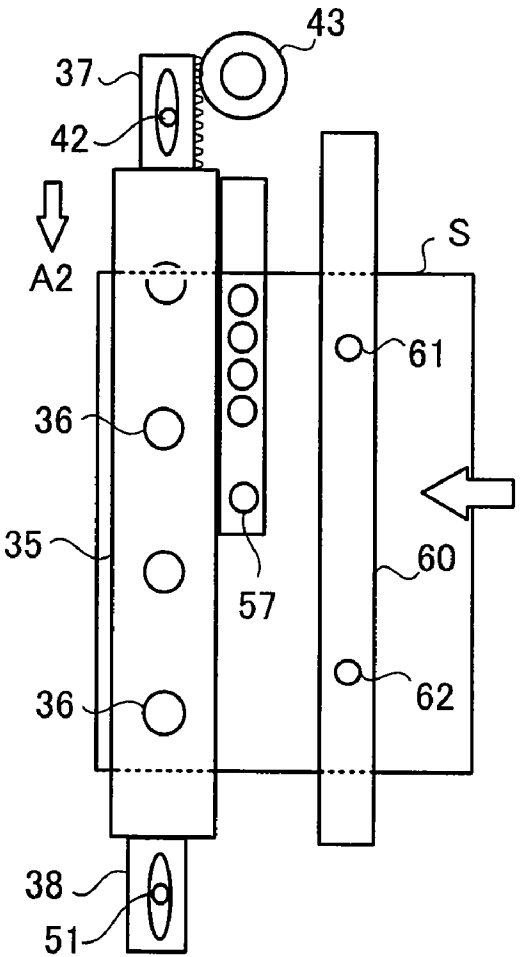
FIGS. 11A and 11B are operation explanatory views showing an example of jam avoidance.
Figure 11A:
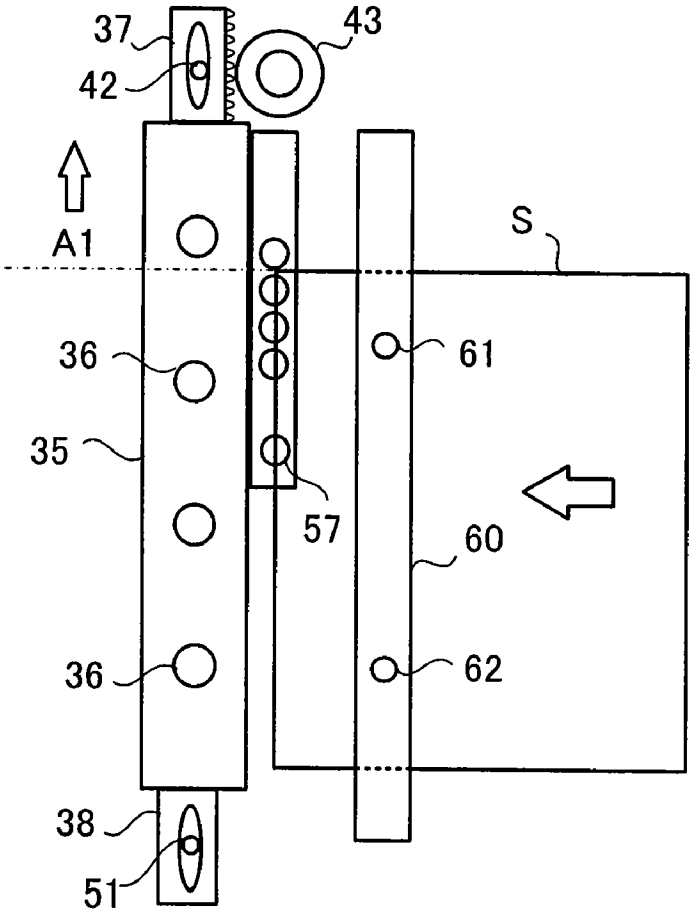

For example, as shown in FIG. 11A, immediately after the leading edge of the sheet S is detected by the sensor 57, the driving of the lateral register motor 44 has only to be started. Since the puncher 35 is moved to the standby position (arrow A1 direction) early, when the front corner of the sheet S passes through the puncher 35, it deviates from the position of the punching blade 36 (the hole 78). Accordingly, the occurrence of a jam can be prevented. Besides, after the leading edge of the sheet S passes through the puncher 35, as shown in FIG. 11B, when the puncher 35 is moved in the arrow A2 direction, the lateral edge of the sheet S can be detected.

Figure 12B:
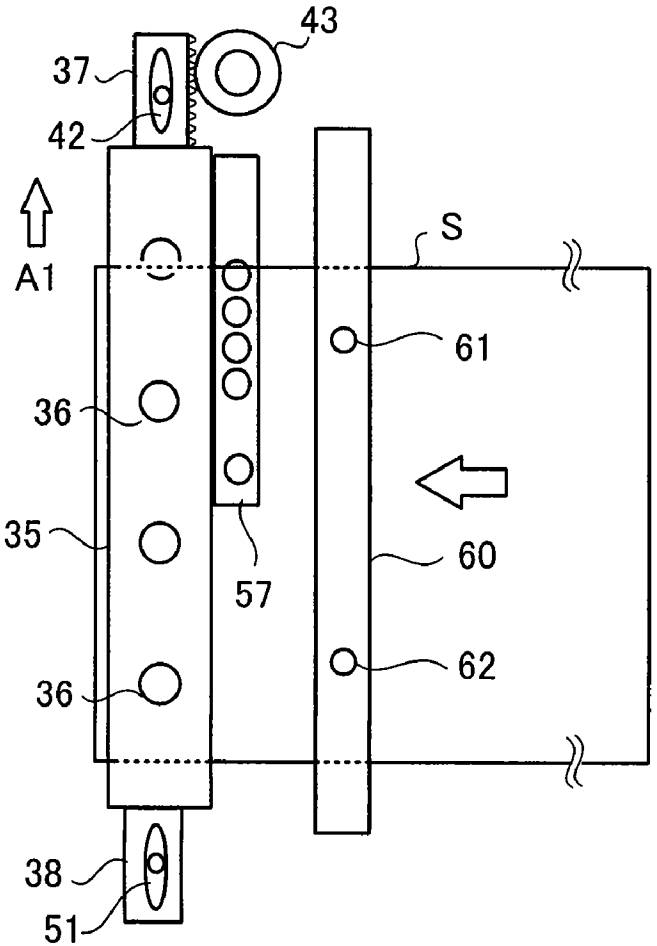
FIGS. 12A and 12B are operation explanatory views showing another example of jam avoidance.
Figure 12A:
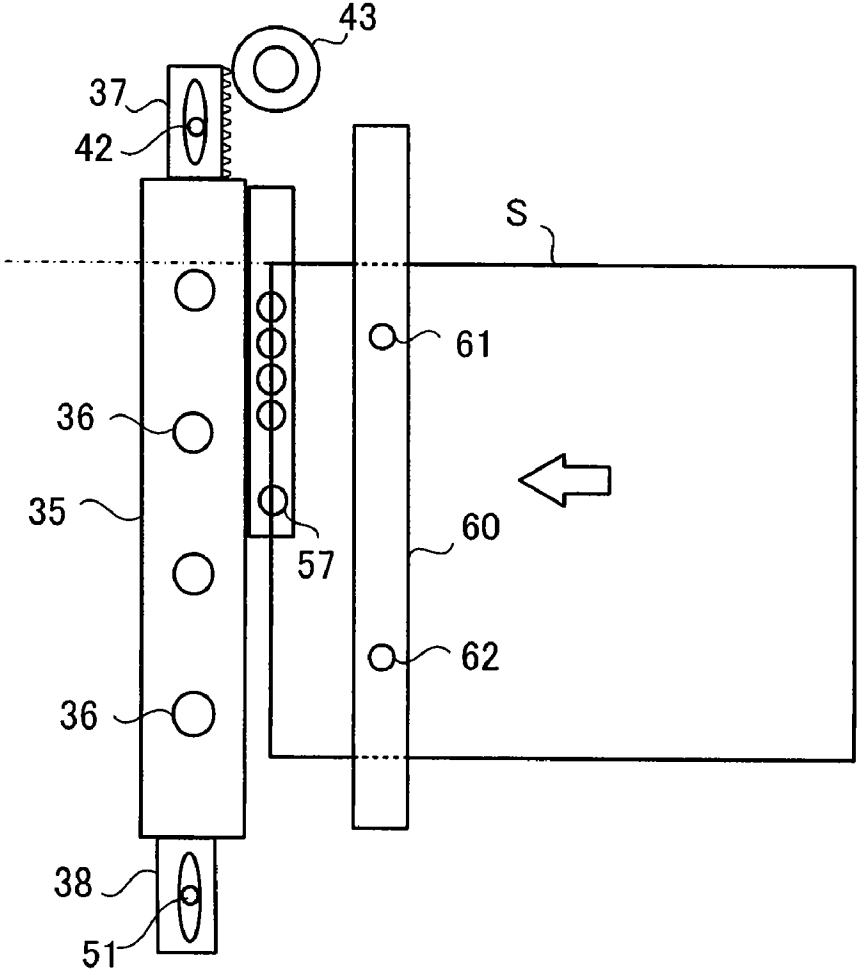

Alternatively, as shown in FIG. 12A, the leading edge of the sheet S is detected by the sensor 57, and after the leading edge of the sheet S passes through the position of the punching blade 36, the driving of the lateral register motor 44 may be started. After the sheet S passes through the position of the punching blade 36, the puncher 35 is moved to the standby position (arrow A1 direction) as shown in FIG. 12B. Thus, when the front corner of the sheet S passes through the puncher 35, it deviates from the position of the hole 78, and the occurrence of a jam can be prevented.

The jam avoidance method of FIGS. 11A and 11B is suitable when the size of the sheet S is small. Besides, the jam avoidance method of FIGS. 12A and 12B is suitable when the size of the sheet S is large.

That is, in the case where the sheet S has a small size (for example, A4), when the method of FIGS. 12A and 12B is applied, since the puncher 35 can not be moved until the leading edge of the sheet S passes through the position of the punching blade 36, the movement to the standby position becomes late. Accordingly, even if the puncher 35 is moved in the reverse direction in order to detect the lateral edge of the sheet S, the sheet S passes through the position of the sensor group 56, and the lateral edge can not be normally detected.

On the other hand, in the case where the sheet S has a large size (for example, A3), even when the method of FIGS. 12A and 12B is applied, since the size of the sheet is long, the lateral edge can be normally detected.

Figure 13A:
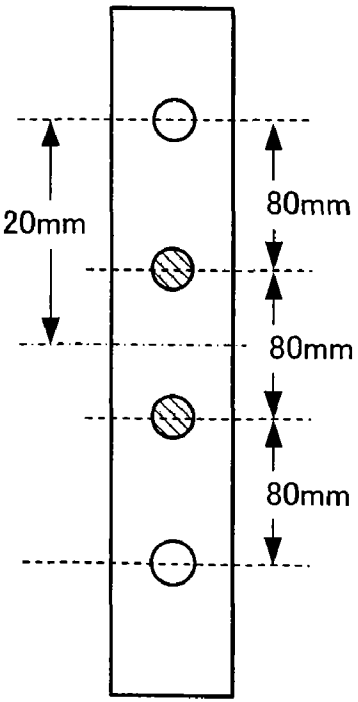
FIGS. 13A, 13B and 13C are explanatory views showing hole types of the puncher.
Figure 13B:
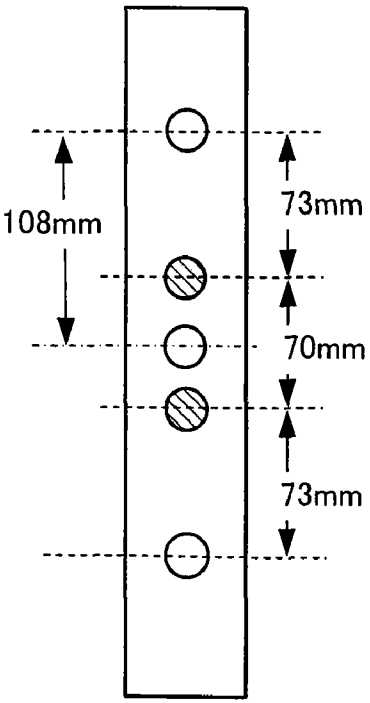
Figure 13C:
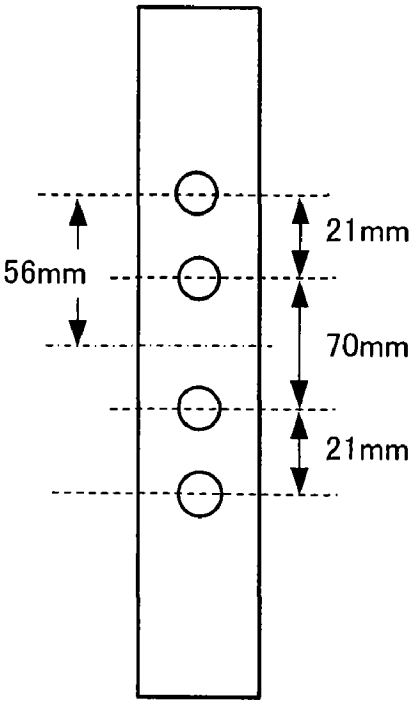

The hole 78 of the puncher 35 has some types as shown in FIGS. 13A to 13C. FIG. 13A shows a type (Japanese or European type) in which two center holes with oblique lines are used to punch, and a type (French type) in which four holes are used to punch.

FIG. 13B shows a type in which two center holes with oblique lines are used to punch, and a type (North American type) in which three holes other than those with oblique lines are used to punch. FIG. 13C shows a type (for example, Swedish type) in which four holes are used to punch. The intervals between the respective holes 78 and the diameters (ϕ) of the holes are different for the respective types of FIGS. 13A to 13C.

Accordingly, when the jam avoidance method of FIGS. 11A and 11B or FIGS. 12A and 12B is used, it is necessary to select the method in view of the sheet size and the type of the hole 78 of the puncher 35.

When the size of the sheet S is large (for example, A3 size), when the detection timing of the lateral edge is made early, the detection difference of the lateral edge becomes large when the sheet S is skewed.

Figures 14, 15A, 15B:
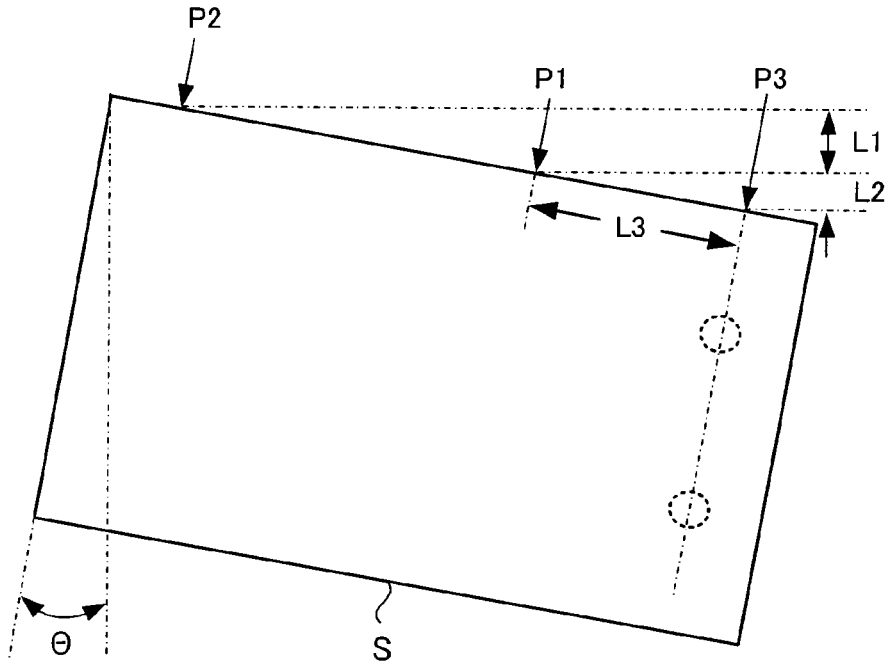
FIG. 14 is an explanatory view of detection of a lateral edge of a skewed sheet.
FIGS. 15A and 15B are explanatory views showing setting examples of timing when the puncher is moved to a standby position.

FIG. 14 shows a state where the sheet S of A3 size is skewed by an angle θ. When the original detection position of the lateral edge is made P1, there occurs a difference in distance L1 when the lateral edge is detected at timing P2 earlier than P1. Besides, when the sheet S has a short size, the difference is almost close to zero.

Accordingly, for the size in which the length of the sheet S is short, there is no problem even when the lateral edge detection is started at an early timing by using the jam avoidance method of FIGS. 11A and 11B. On the other hand, for the size in which the sheet S is long, the jam avoidance method of FIGS. 12A and 12B is used, and the detection timing of the lateral edge is delayed. That is, in the method of FIGS. 12A and 12B, after the leading edge of the sheet S passes through the puncher 35, the puncher 35 is moved to the standby position, and after the standby, driving for lateral edge detection is started. Thus, the lateral edge can be detected at a position close to the timing P1.

Besides, after the leading edge of the sheet S is detected by the sensor 57, the timing when driving of the lateral register motor 44 is started is regulated for each sheet size, and the lateral edge can be detected at the just appropriate timing P1.

When the sheet S is skewed, and when a distance from the detection position P1 of the lateral edge to a position P3 where a hole is bored is made L3, since the skew amount θ can be detected by the skew sensor 60, a detection difference L2 of the lateral edge due to the skew can be represented by $$L2=L3\times\cos\theta$$

and this difference amount is added and the movement amount of the puncher 35 is set.

In addition, the jam avoidance method of FIGS. 11A and 11B relates to movement speed V1 of the sheet S. That is, a time elapsed before the sheet S passes through the position of the punching blade 36 after the leading edge of the sheet S is detected by the sensor 57 varies according to the movement speed V1. Accordingly, after the sensor 57 detects the leading edge of the sheet S, the timing when the driving of the lateral register motor 44 is started is regulated by the number of pulses of the conveyance motor 59, and the front corner of the sheet S is made not to enter the hole 78. The number of pulses varies according to the movement speed V1 of the sheet S.

The conveyance motor 59 is the stepping motor, and can control the conveyance distance of the sheet by the number of pulses, and therefore, the number of pulses is set as shown in FIGS. 15A and 15B.

FIG. 15A shows the number of pulses set for the respective movement speeds of the sheets S when the sheets S have an A4 size and an LT size in the two-hole and four-hole puncher 35 (FIG. 13A).

For example, when the sheet size is A4 and the movement speed is 800 mm/sec, the number of pulses is zero, and immediately after the sensor 57 detects the leading edge of the sheet S, driving of the lateral register motor 44 is started to move the puncher 35 to the standby position. Besides, when the sheet size is LT and the movement speed is 800 mm/sec, the number of pulses is a1 (a1>0), and after the sensor 57 detects the leading edge of the sheet S, driving of the lateral register motor 44 is started at the time point when the sheet is conveyed by the number a1 of pulses, and the puncher 35 is moved to the standby position. Besides, as the movement speed of the sheet S becomes low, the set numbers a2, a4 and a3, a5 of pulses are increased.

When the puncher 35 is of the two-hole and four-hole type (FIG. 13A), and the sheets S have an A4 size and an LT size, since the front corner of the sheet S passes over the hole 78, the puncher 35 is moved to the standby position early. After moving to the standby position, the puncher 35 moves in the reverse direction (arrow A2 direction) in order to detect the lateral edge of the sheet S.

FIG. 15B shows the number of pulses set for the respective movement speeds of the sheets S when the sheets S have an A4 size and an LT size in the two-hole and three-hole puncher 35.

For example, when the sheet size is A4 and the movement speed is 800 mm/sec, the number of pulses is b0 (b0>0), and after the sensor 57 detects the leading edge of the sheet S, driving of the lateral register motor 44 is started at the time point when the sheet is conveyed by the number b0 of pulses.

When the sheet size is LT and the movement speed is 800 mm/sec, the number of pulses is b1 (b1>b0), and after the sensor 57 detects the leading edge of the sheet S, driving of the lateral register motor 44 is started at the time point when the sheet is conveyed by the number b1 of pulses. Besides, as the movement speed of the sheet S becomes low, the set numbers b2, b4 and b3, b5 of pulses are increased.

When the puncher 35 is of the two-hole and three-hole type (FIG. 13B) and the sheets S have an A4 size and an LT size, since the front corner of the sheet S does not pass over the hole 78, it is not necessary to accelerate the driving start of the lateral register motor 44. Accordingly, as compared with FIG. 15A, the number of pulses is increased.

On the other hand, in the jam avoidance method of FIGS. 11A and 11B, the movement of the puncher 35 to the standby position is triggered by the detection result of the sensor 57 disposed at the downstream side in the sheet conveyance path. However, when the detection result of the sensor 57 is made the trigger, there is a possibility that when the movement speed V1 of the sheet S is high, the movement of the puncher 35 to the standby position is delayed, and the lateral edge detection is not in time.

Figure 16B:
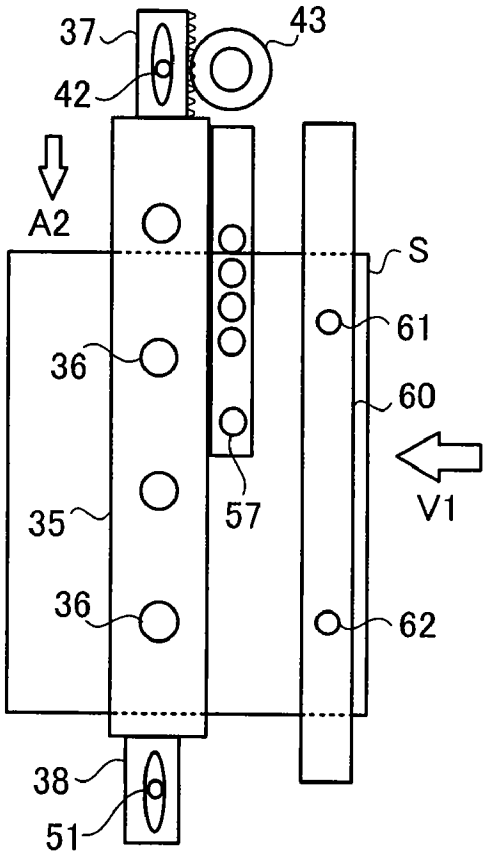
FIGS. 16A and 16B are explanatory views showing detection of a leading edge of a sheet by a skew sensor.
Figure 16A:
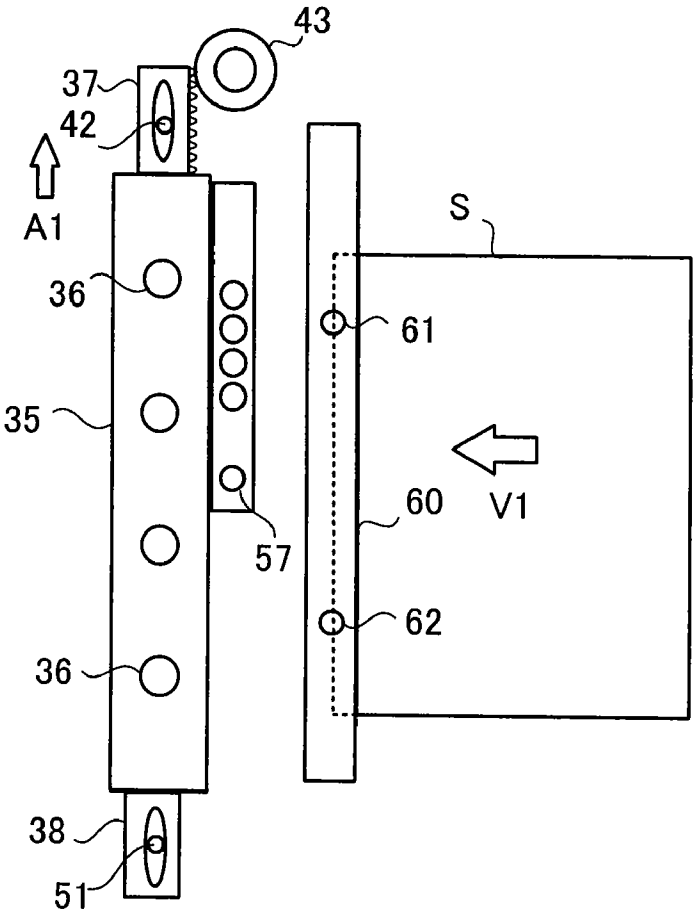

Then, when the movement speed V1 of the sheet S is high, as shown in FIG. 16A, the leading edge of the sheet S is detected by the sensor 61 or 62 (skew sensor) disposed at the upstream side in the sheet conveyance path, and the movement of the puncher 35 to the standby position is triggered by the detection result of the skew sensor 61 or 62.

Since there is a certain distance between the sensor 61 or 62 and the sensor 57, when the detection result of the upstream skew sensor is made the trigger, the puncher 35 can be moved to the standby position early, and as shown in FIG. 16B, the detection of the lateral edge of the sheet S can be performed in good time.

Besides, the jam avoidance method of FIGS. 12A and 12B also relates to the movement speed V1 of the sheet S.

Figure 17A:
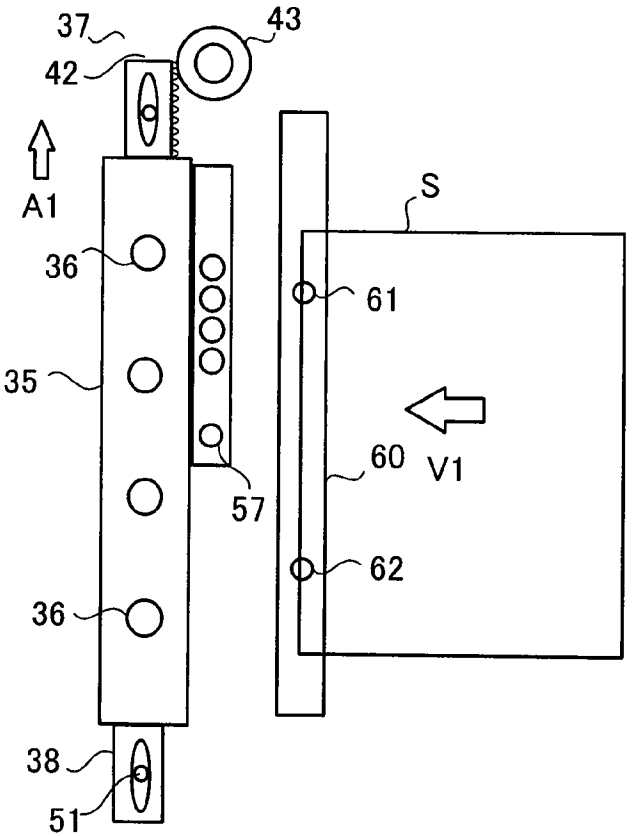
FIGS. 17A, 17B and 17C are explanatory views showing another example of detection of a leading edge of a sheet by the skew sensor.
Figure 17B:
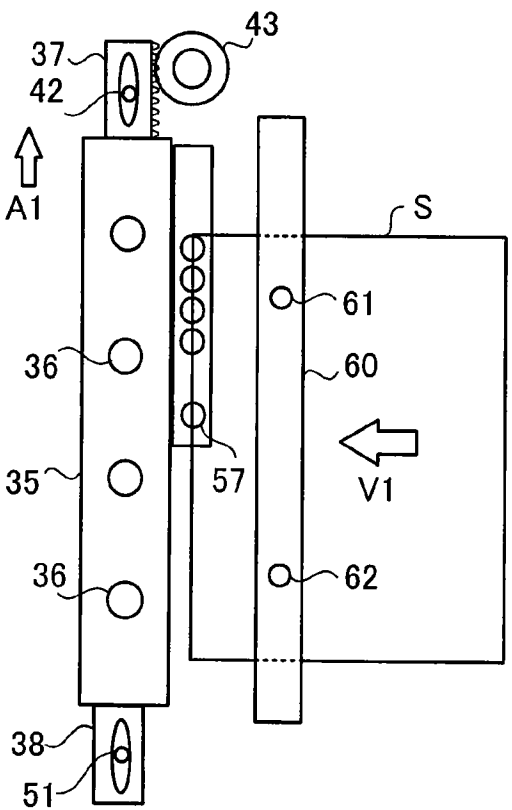
Figure 17C:
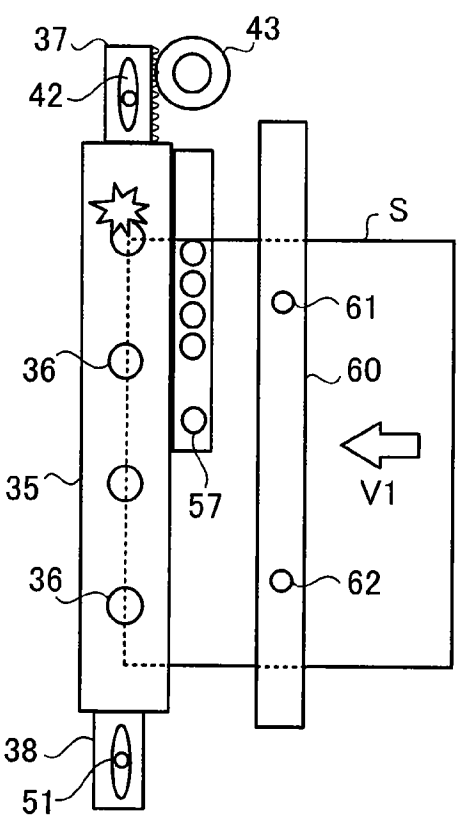

That is, as shown in FIG. 17A, when the movement speed V1 of the sheet S is low, when the movement of the puncher 35 to the standby position is triggered by the detection result of the sensor 61 or 62 at the upstream side in the conveyance path, as shown in FIG. 17B, there is a possibility that the movement to the standby position is ended before the sheet S is conveyed to the puncher 35, and as shown in FIG. 17C, the front corner of the sheet S passes the position of the punching blade 36 (hole 78).

Besides, the movement amount of the puncher 35 to the standby position varies not only by the movement speed of the sheet S but also by the size of the sheet S. Accordingly, the movement start timing of the puncher 35 to the standby position is selected according to the sheet size and the movement speed.

Figure 18:
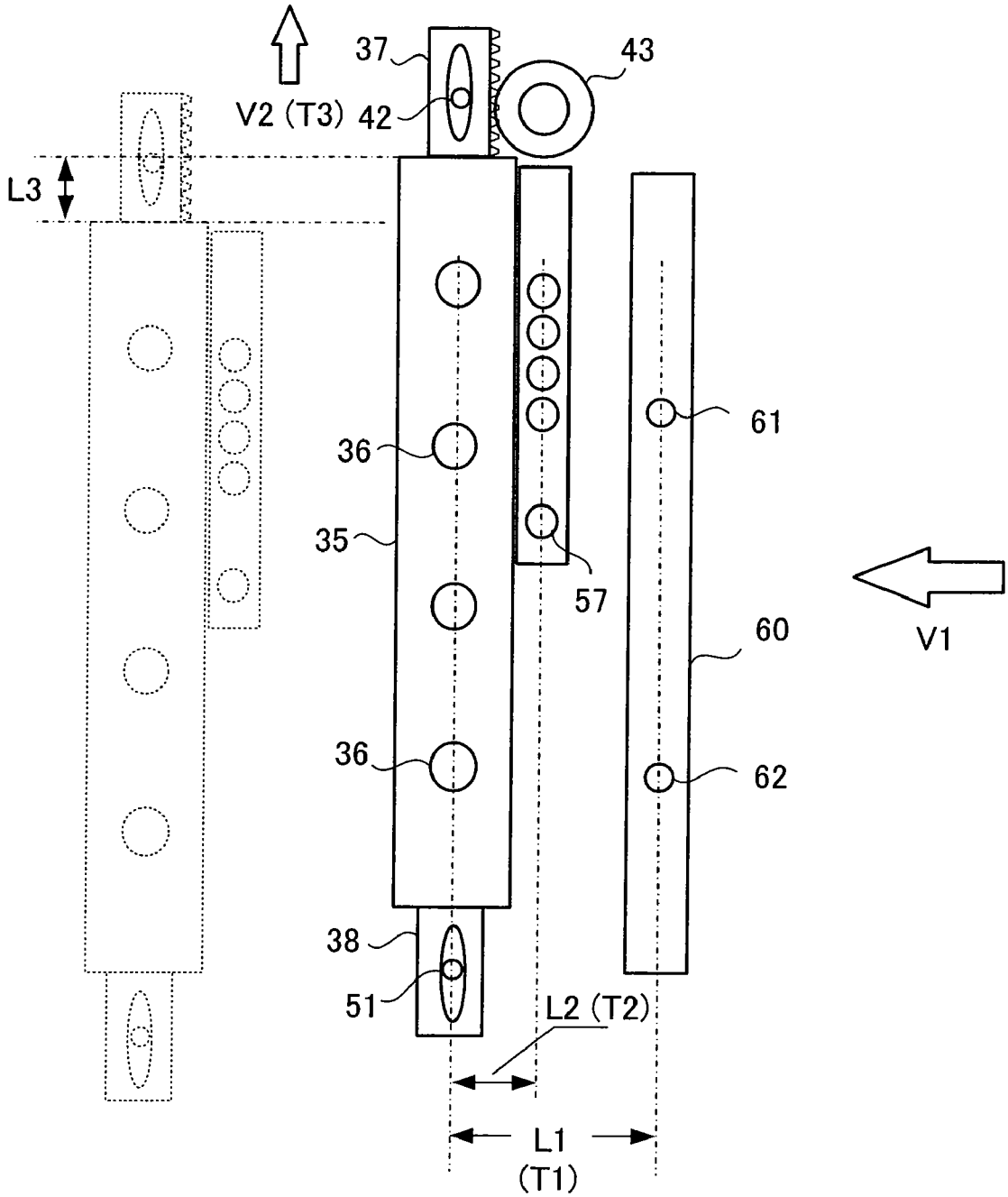
FIG. 18 is an explanatory view showing a relation between a movement speed of a sheet and a movement speed of a puncher.

That is, as shown in FIG. 18, the movement speed of the sheet S is V1, the movement speed of the puncher 35 by the lateral register motor 44 is V2, the distance from the skew sensor 61, 62 to the punching blade 36 is L1, the distance from the sensor 57 to the punching blade 36 is L2, and the distance of movement of the puncher 35 from the penetrate position to the standby position is L3.

A time T1 elapsed before the sheet S reaches the position of the punching blade 36 after the sheet passes through the skew sensor 61, 62 is T1=L1/V1. A time T2 elapsed before the sheet S reaches the position of the punching blade 36 after the sheet passes through the sheet detection sensor 57 is T2=L2/V1. A time T3 required for the puncher 35 to move from the penetrate position to the standby position is T3=L3/V2.

The control section 201 (FIG. 3) controls the driving start timing of the lateral register motor 44 by the times T1, T2 and T3, and controls the movement start timing of the puncher 35 from the penetrate position to the standby position as described in the following paragraphs 1 to 3.

1. In the case of T3>T1, driving start of the lateral register motor 44 is triggered by the detection of the leading edge of the sheet S by the skew sensor 61, 62.

2. In the case of T1>T3>T2, driving start of the lateral register motor 44 is triggered by the detection of the leading edge of the sheet S by the sheet sensor 57.

3. In the case of T2>T3, driving of the lateral register motor 44 is started after the time of (T2−T3) or more elapses since the skew sensor 61, 62 or the sheet sensor 57 detects the leading edge of the sheet S.

In the above embodiment, the drive timing of the lateral register motor 44 is controlled according to the sheet size, the movement time T1, T2 of the sheet S, the movement time T3 of the puncher 35 and the like, so that the occurrence of a jam can be prevented.

The skew sensor 61, 62, or the sheet sensor 57 constitutes a first detection section to detect the leading edge of the sheet, and the sensor group 56 constitutes a second detection section to detect the lateral edge of the sheet.

Figure 19A:
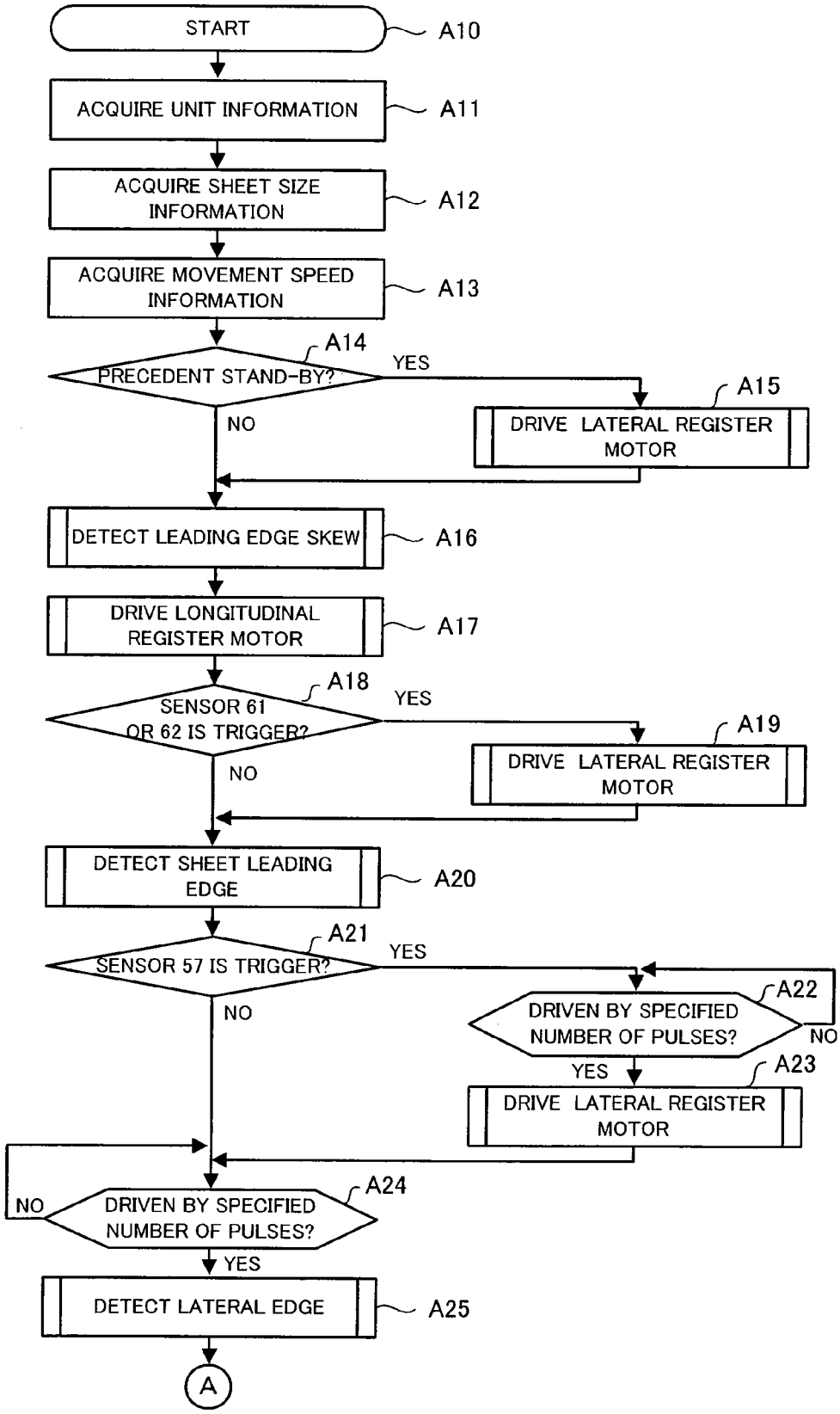
FIGS. 19A and 19B are flowcharts showing an operation of a punch unit.
Figure 19B:
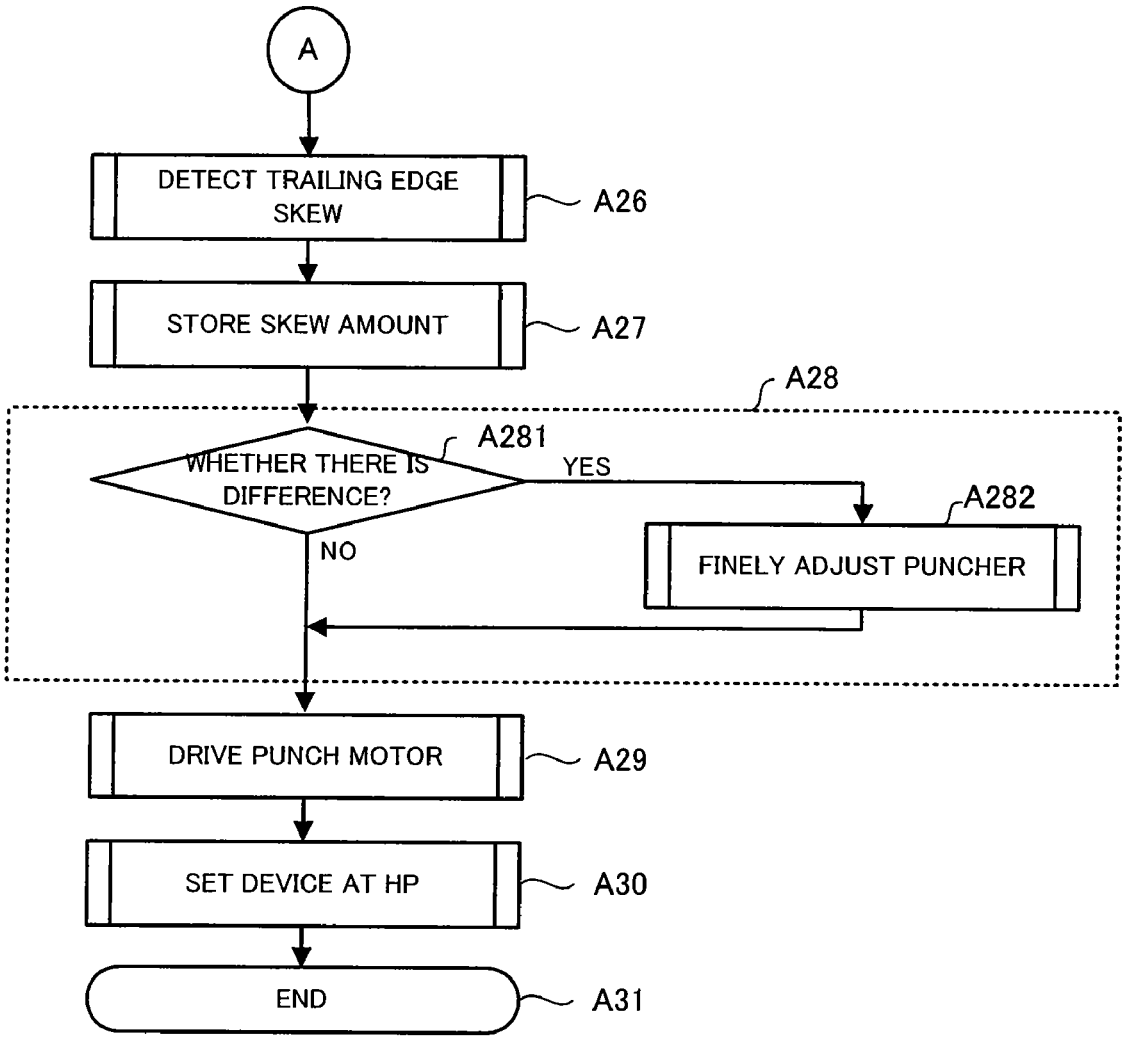

FIGS. 19A and 19B are flowcharts for explaining the operation of the punch unit 30.

In FIG. 19A, Act A10 indicates the operation start of the punch unit 30, and at ACT A11, unit information, for example, information of the hole type (FIG. 13A to FIG. 13C) of the puncher 35 is acquired. At Act A12, information of a sheet size is acquired, and at Act A13, information of a movement speed of a sheet is acquired.

Based on the information acquired at Acts A11 to A13, at Act A14 is determined whether the puncher 35 is precedently moved to the standby position or not. For example, when the sheet size is A4 and the movement speed is high, the determination is the precedent standby (YES), and at Act A15, the lateral register motor 44 is driven, and the puncher 35 is precedently moved to the standby position (see FIG. 11A).

When the determination of Act A14 is NO, and after Act A15, the skew of the leading edge of the sheet is detected by the skew sensor 61, 62 at Act A16, and the longitudinal register motor 53 is driven to incline the puncher 35 according to the skew amount of the leading edge at Act A17.

At Act A18, it is determined whether the movement of the puncher 35 is triggered by the detection of the leading edge by the skew sensor 61, 62. That is, when the puncher 35 does not precedently stand by, and the movement speed of the sheet is high, the driving of the lateral register motor 44 is triggered by the detection result of the skew sensor 61, 62 at Act A19, and the puncher 35 is moved to the standby position.

When the determination of Act A18 is NO, at Act A20, the sensor 57 detects the leading edge of the sheet. At Act A21, it is determined whether the movement of the puncher 35 is triggered by the detection of the leading edge by the sensor 57. That is, when the puncher 35 does not precedently stand by, and the movement speed of the sheet is low, the detection result of the sensor 57 is made the trigger, and at Act A22, the lateral register motor 44 is driven by a specified number of pulses, and at Act A23, the lateral register motor 44 is driven to move the puncher 35 to the standby position.

When the determination of Act A21 is NO, Act A21 is determined that the precedent standby is performed or the detection result of the skew sensor 61, 62 is made the trigger, and the puncher 35 already starts to move to the standby position. At Act A24, the lateral register motor 44 is driven by a specified number of pulses (see FIGS. 15A and 15B), the puncher 35 is moved in the reverse direction at Act A25, and the lateral edge of the sheet is detected.

Similarly, at Act A23, also when the puncher 35 is moved to the standby position, at Act A24, the lateral register motor 44 is driven by a specified number of pulses, and at Act A25, the puncher 35 is moved in the reverse direction, and the lateral edge of the sheet is detected.

Next, in FIG. 19B, at Act A26, the skew detection section 60 detects the skew amount of the trailing edge of the sheet, and at Act A27, data of the detected skew amount is stored. The data is stored in the storage section of the RAM or the like in the control section 201.

At Act A281 of Act A28 is determined whether there is a difference between the skew amount of the leading edge and the skew amount of the trailing edge, and when there is a difference, at Act A282, the longitudinal register motor 53 is driven, and the inclination of the puncher 35 is finely adjusted by the amount of the difference.

After the skew correction is performed, the sheet is conveyed to a specified position where punching is performed, and the driving of the conveyance motor 59 is stopped. At Act A29, the punch motor 58 is driven to move down the punching blade 36 and a punch hole is bored in the sheet. After the punch hole is bored, at Act A30, the respective devices are set at the home positions (HP), and at Act A31, the punch process is ended.

In the first embodiment, the drive timing of the lateral register motor 44 is controlled based on the information of the hole type of the puncher 35, the sheet size, the sheet movement speed and the like, so that the front corner of the sheet is not caught by the punch hole 78 and the sheet can be normally conveyed.

Next, a second embodiment will be described.

In the skew correction by the posture control mechanism 302 (FIG. 2), the skew amount (inclination angle θ) of the leading edge of the sheet S is calculated by the skew sensor 61, 62, the longitudinal register motor 53 is driven according to the inclination angle θ to incline the puncher 35, and the skew correction of the sheet S is performed.

Besides, when the trailing edge of the sheet S passes through the position of the skew sensor 61, 62, the skew amount of the trailing edge is measured, and when there is a difference between the skew amount of the leading edge and the skew amount of the trailing edge, the longitudinal register motor 53 is driven by the amount of the difference.

Figure 20B:
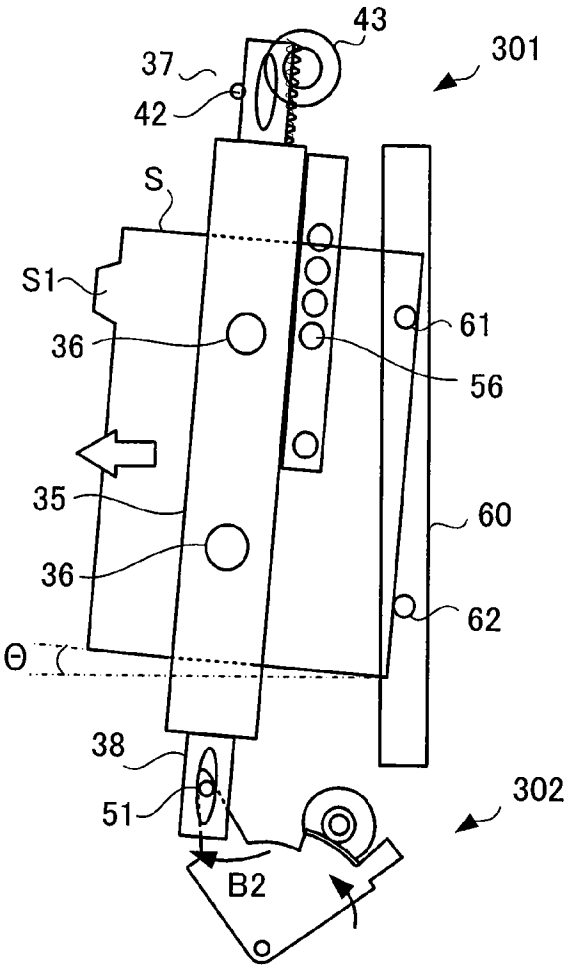
FIGS. 20A and 20B are explanatory views showing a skew correction operation when a tab sheet is finished.
Figure 20A:
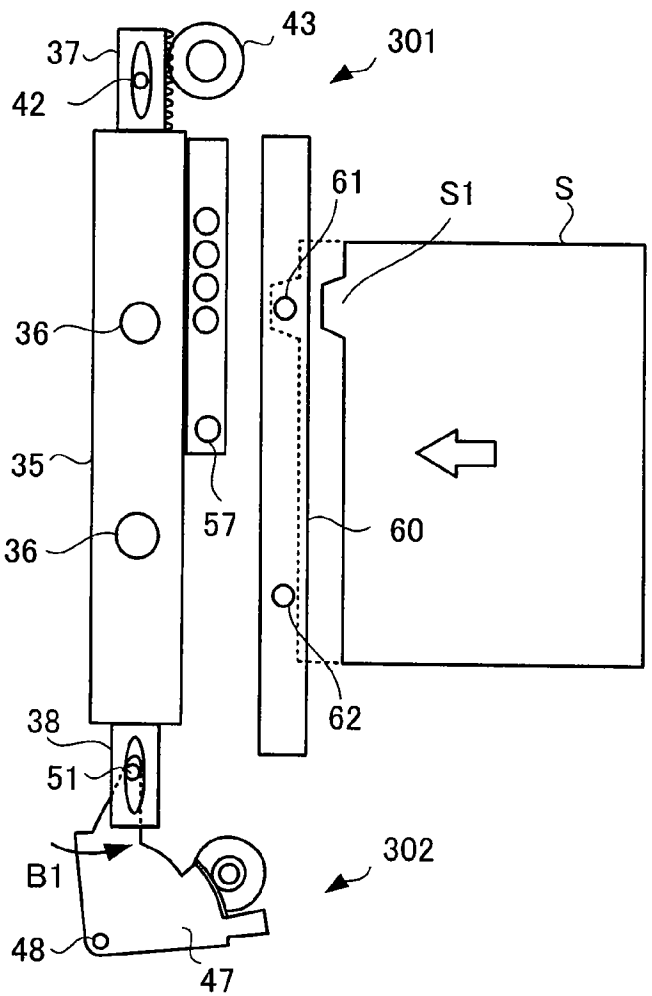

However, as shown in FIG. 20A, when a sheet S (hereinafter referred to as a tab sheet) having a tab S1 at the position of the skew sensor 61, 62 is finished, even if the tab sheet S is not skewed and is conveyed, the skew detection section 60 is determined from the tab S1 that there is a skew. Further, since the skew amount becomes a value outside a specified range, an error occurs. On the other hand, a normal skew amount can be detected at the trailing edge of the tab sheet S.

Then, in the second embodiment, the skew amount of the leading edge of the sheet S is measured by the skew detection section 60, and when the measured skew amount is a value outside the specified range, the control section 201 is determined that the sheet is the tab sheet. Then, the control section 201 is assumed that there is no skew at the leading edge, and the posture of the puncher 35 is controlled to the center position. That is, as shown in FIG. 20A, the puncher 35 is controlled to be perpendicular to the conveyance direction of the sheet S.

As shown in FIG. 20B, when the trailing edge of the sheet S passes through the position of the skew sensor 61, 62, the skew amount of the trailing edge is detected, and the angle of the puncher 35 is controlled based on the skew amount of the trailing edge, and the skew correction is performed.

Most of the skews do not occur abruptly, but occurs when the punch unit 30 is attached or the user sets sheets on the cassette 18, and therefore, similar skews occur in most cases.

Accordingly, when tab sheets are conveyed in the second and subsequent sheets, data of the skew amount of a trailing edge obtained when a tab sheet is previously conveyed is stored. When the skew amount outside the specified range is detected at the skew detection of a leading edge, the skew correction of the leading edge is performed based on the stored data of the skew amount. After the skew correction of the leading edge is performed, the skew amount of the trailing edge is measured, and the angle of the puncher 35 is finely adjusted by the amount of the difference between the stored skew amount and the skew amount of the trailing edge.

Figure 21:
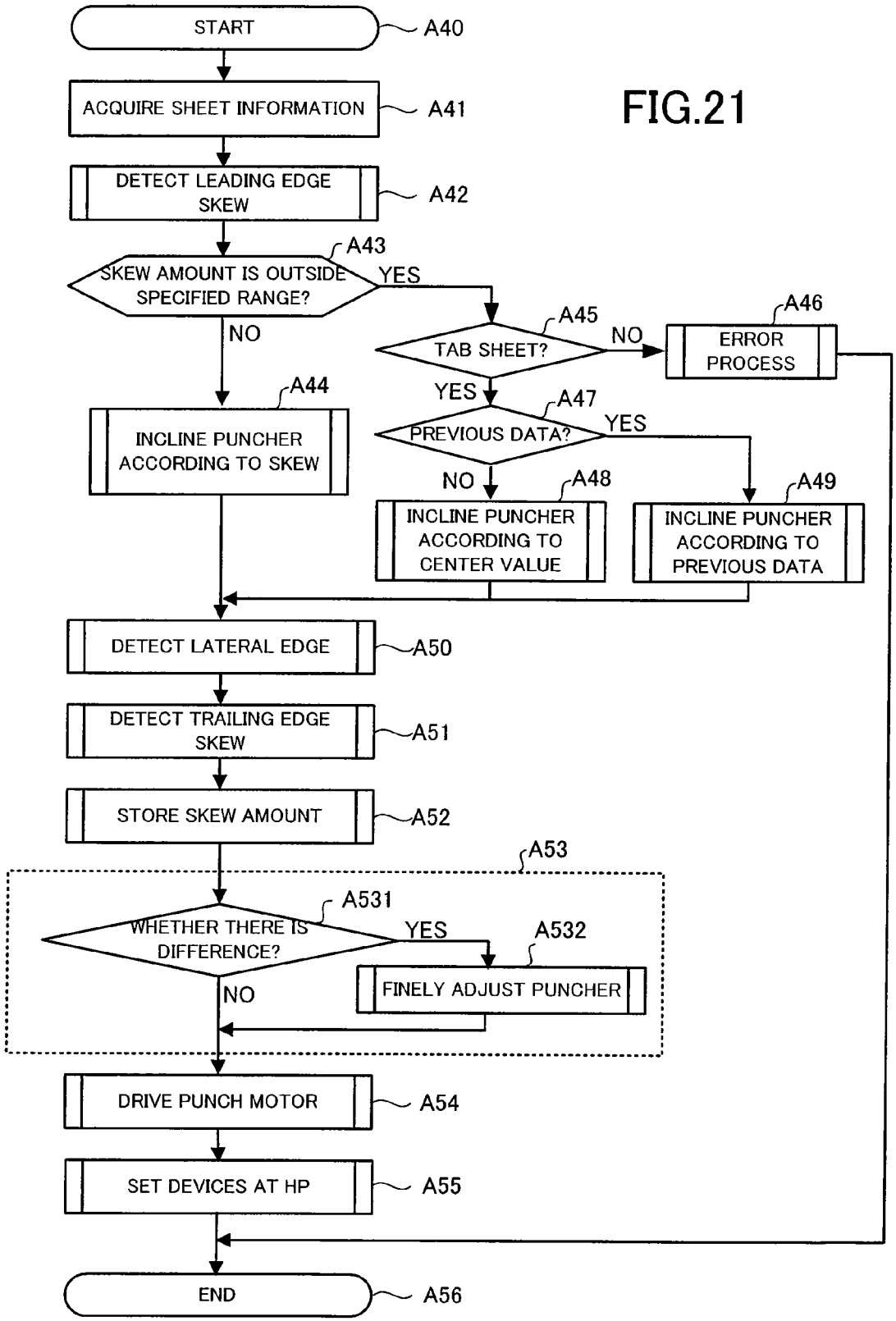
FIG. 21 is a flowchart showing the skew correction operation when the tab sheet is finished.

FIG. 21 is a flowchart for explaining the operation of the skew correction when the tab sheet is finished.

In FIG. 21, Act A40 indicates the operation start of the punch unit 30, and at Act A41, sheet information, that is, information indicating whether the sheet is the tab sheet or the normal sheet is acquired. Whether the sheet has a tab or not is known from the input of the operation panel 13. For example, when the tab sheet is set on the MFP 10, it is inputted by the operation panel 13 that the tab sheet is set.

Besides, an inserter is provided between the MFP 10 and the punch unit 30, and the tab sheet may be conveyed to the punch unit 30 through the inserter. Also when the tab sheet is conveyed using the inserter, it is inputted by the operation panel 13 that the tab sheet is set.

At Act A42, the skew of the leading edge of the sheet is detected by the skew sensor 61, 62, and at Act A43 is determined whether the skew amount is outside the specified range. When the skew amount is within the specified range, at Act A44, the longitudinal register motor 53 is driven according to the skew amount, and the puncher 35 is inclined.

When the skew amount is outside the specified range, at Act A45 is determined whether the sheet is the tab sheet or not. When the sheet is not the tab sheet, at Act A46, an error process is performed and the operation is ended. When the sheet is the tab sheet, at Act A47 is determined whether previous data exists. When there is no previous data, at Act A48, the puncher 35 is inclined according to the center value. When there is previous data, at Act A49, the puncher 35 is inclined according to the previous data.

At Act A50, the lateral edge of the sheet is detected. At Act A51, the skew detection section 60 detects the skew amount of the trailing edge of the sheet, and at Act A52, data of the detected skew amount is stored. At Act A531 of Act A53 is determined whether there is a difference between the skew amount (center value or previous data) of the leading edge and the skew amount of the trailing edge. When there is a difference, at Act A532, the longitudinal register motor 53 is driven, and the inclination of the puncher 35 is finely adjusted by the amount of the difference.

After the skew correction is performed, the sheet is conveyed to the specified position where punching is performed, and the driving of the conveyance motor 59 is stopped. At Act A54, the punch motor 58 is driven to move down the punching blade 36, and a punch hole is bored in the sheet. After the punch hole is bored, at Act A55, the respective devices are set at the home positions (HP), and at Act A56, the punch process is ended.

In the second embodiment, the skew correction is accurately performed even for the tab sheet, and the punch hole can be bored at the specified position.

The present invention is not limited to the above embodiments, but can be variously modified within the scope not departing from the claims.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:

a conveyance mechanism to convey a sheet supplied from an image forming apparatus in a conveyance direction;

a puncher having a plurality of punching blades and a corresponding plurality of punching blade receiving holes to bore punch holes in the sheet conveyed by the conveyance mechanism;

a moving mechanism to locate the puncher at a penetrate position where the punch holes are bored in the sheet and a standby position where the puncher is retracted from the penetrate position in a direction perpendicular to the conveyance direction;

a first detection section which is disposed upstream of the puncher in the conveyance direction and detects a leading edge of the sheet;

a second detection section which is disposed upstream of the puncher in the conveyance direction and detects a lateral edge of the sheet while the puncher is moved from the standby position to the penetrate position; and a control section which controls the moving mechanism based on a detection timing of the first detection section and according to a size of the sheet and a movement speed of the sheet, and prevents a front corner of the sheet from coinciding with one of the punching blade receiving holes, wherein the control section controls a movement start timing of the puncher to the standby position according to positions of the punching blade receiving holes and the number of the punching blade receiving holes.

2. The apparatus of claim 1, wherein the control section controls the moving mechanism to start movement of the puncher before the sheet passes between the punching blades and the corresponding punching blade receiving holes so that the front corner of the sheet does not overlap with the punching blade receiving holes during a period the sheet passes through the puncher.

3. The apparatus of claim 1, wherein the control section controls the moving mechanism to start movement of the puncher after the sheet passes between the punching blades and the corresponding punching blade receiving holes so that the front corner of the sheet does not overlap with the punching blade receiving holes during a period when the sheet passes through the puncher.

4. The apparatus of claim 1, wherein the first detection section includes a skew sensor which is disposed upstream of the puncher in the conveyance direction and detects a skew of the sheet, and a leading edge sensor which is disposed between the skew sensor and the puncher and detects the leading edge and of the sheet, and the control section selects, as a trigger, one of detection results of the skew sensor and the leading edge sensor based on the movement speed of the sheet and a movement speed of the puncher to the standby position, and, in response to the selected trigger, controls the moving mechanism to start the movement of the puncher.

5. The apparatus of claim 4, wherein when the movement speed of the sheet is higher than a previously set speed, the control section selects the detection result of the skew sensor as the trigger.

6. The apparatus of claim 4, wherein when the movement speed of the sheet is lower than a previously set speed, the control section selects the detection result of the leading edge sensor as the trigger.

7. The apparatus of claim 1, wherein the control section controls the moving mechanism to move the puncher in a direction of the standby position in synchronization with conveyance of the sheet, and then to move the puncher in a reverse direction, and the control section sets the penetrate position of the puncher according to a result of lateral edge detection of the sheet by the second detection section, and sets a movement start timing of the puncher to the standby position to cause the lateral edge detection to be ended before the sheet passes through the second detection section.

8. A sheet punching apparatus comprising:

a puncher having a plurality of punching blades and a corresponding plurality of punching blade receiving holes to bore punch holes in a conveyed sheet;

a moving mechanism to locate the puncher at a penetrate position where the punch holes are bored in the sheet and a standby position where the puncher is retracted from the penetrate position in a direction perpendicular to a conveyance direction of the sheet;

a first detection section which is disposed upstream of the puncher in the conveyance direction and detects a leading edge of the sheet;

a second detection section which is disposed upstream of the puncher in the conveyance direction and detects a lateral edge of the sheet while the puncher is moved from the standby position to the penetrate position; and a control section which controls the moving mechanism based on a detection timing of the first detection section and according to a size of the sheet and a movement speed of the sheet, and prevents a front corner of the sheet from coinciding with one of the punching blade receiving holes, wherein the control section controls a movement start timing of the puncher to the standby position according to positions of the punching blade receiving holes and the number of the punching blade receiving holes.

9. The apparatus of claim 8, wherein the control section controls the moving mechanism to start movement of the puncher before the sheet passes between the punching blades and the corresponding punching blade receiving holes so that the front corner of the sheet does not overlap with the punching blade receiving holes during a period when the sheet passes through the puncher.

10. The apparatus of claim 8, wherein the control section controls the moving mechanism to start movement of the puncher after the sheet passes between the punching blades and the corresponding punching blade receiving holes so that the front corner of the sheet does not overlap with the punching blade receiving holes during a period when the sheet passes through the puncher.

11. The apparatus of claim 8, wherein the first detection section includes a skew sensor which is disposed upstream of the puncher in the conveyance direction and detects a skew of the sheet and a leading edge sensor which is disposed between the skew sensor and the puncher and detects the leading edge of the sheet, and the control section selects, as a trigger, one of detection results of the skew sensor and the leading edge sensor based on the movement speed of the sheet and a movement speed of the puncher to the standby position, and, in response to the selected trigger, sets a movement start timing of the puncher to the standby position.

12. The apparatus of claim 11, wherein when the movement speed of the sheet is higher than a previously set speed, the control section selects, as the trigger, the detection result of the skew sensor.

13. The apparatus of claim 11, wherein when the movement speed of the sheet is lower than a previously set speed, the control section selects, as the trigger, the detection result of the leading edge sensor.

14. The apparatus of claim 8, wherein the control section controls the moving mechanism to move the puncher in a direction of the standby position in synchronization with conveyance of the sheet and then to move the puncher in a reverse direction, sets the penetrate position of the puncher according to a result of lateral edge detection of the sheet by the second detection section, and sets the movement start timing of the puncher to the standby position to cause the lateral edge detection to be ended before the sheet passes through the second detection section.

15. A control method of a sheet finishing apparatus, comprising:

providing a puncher having a plurality of punching blades and a corresponding plurality of punching blade receiving holes to bore punch holes in a conveyed sheet and a moving mechanism to move the puncher between a penetrate position where the punch holes are bored in the sheet and a standby position where the puncher is retracted from the penetrate position in a direction perpendicular to a conveyance direction;

detecting a leading edge of the sheet at an upstream side of the puncher in the conveyance direction;

detecting, while the puncher is moved from the standby position to the penetrate position, a lateral edge of the sheet at the upstream side of the puncher in the conveyance direction;

controlling the moving mechanism based on a detection timing of the first detection section and according to a size of the sheet and a movement speed of the sheet, and prevents a front corner of the sheet from coinciding with one of the punching blade receiving holes; and controlling a movement start timing of the puncher to the standby position according to positions of the punching blade receiving holes and the number of the punching blade receiving holes.

16. The method of claim 15, wherein the moving mechanism is controlled to start movement of the puncher before the sheet passes between the punching blades and the corresponding punching blade receiving holes so that the front corner of the sheet overlaps does not overlap with the punching blade receiving holes during a period the sheet passes through the puncher.

17. The method of claim 15, wherein the moving mechanism is controlled to start movement of the puncher after the sheet passes between the punching blades and the corresponding punching blade receiving holes so that the front corner of the sheet does not overlap with the punching blade receiving holes during a period the sheet passes through the puncher.

18. The method of claim 15, wherein after the puncher is moved in a direction of the standby position, the puncher is moved in a reverse direction, the lateral edge of the conveyed sheet is detected, the penetrate position of the puncher is set according to a detection result of the lateral edge, and a movement start timing of the puncher to the standby position is set to end the lateral edge detection before the sheet passes through the sensor to detect the lateral edge.

* * * * *